US011913450B2

(12) United States Patent
Jang et al.

(10) Patent No.: US 11,913,450 B2
(45) Date of Patent: Feb. 27, 2024

(54) SCROLL COMPRESSOR INCLUDING DISCHARGE GUIDE TO QUICKEN DISCHARGE REFRIGERANT FLOW MOVEMENT

(71) Applicant: LG Electronics Inc., Seoul (KR)

(72) Inventors: Jinyong Jang, Seoul (KR); Sanghun Seong, Seoul (KR); Honghee Park, Seoul (KR); Byeonghun Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/987,446

(22) Filed: Nov. 15, 2022

(65) Prior Publication Data

US 2023/0167819 A1 Jun. 1, 2023

(30) Foreign Application Priority Data

Nov. 30, 2021 (KR) ..... 10-2021-0169214

(51) Int. Cl.
*F04C 18/02* (2006.01)
*F01C 21/10* (2006.01)
(Continued)

(52) U.S. Cl.
CPC ..... *F04C 18/0215* (2013.01); *F01C 21/18* (2013.01); *F04C 29/12* (2013.01);
(Continued)

(58) Field of Classification Search
CPC .. F04C 18/0215; F04C 29/12; F04C 2240/30; F04C 2240/40; F04C 2240/80;
(Continued)

(56) References Cited

U.S. PATENT DOCUMENTS 5,649,816 A * 7/1997 Wallis ..... F04C 18/0253 417/313
6,280,154 B1 * 8/2001 Clendenin ..... F04C 23/008 417/410.5
(Continued)

FOREIGN PATENT DOCUMENTS

CN 212389518 U * 1/2021 ..... F04C 18/0215
JP H0579477 3/1993
(Continued)

OTHER PUBLICATIONS

English Machine Translation of JPH11201060A, translated via USPTO Fit Datebase (Year: 1999).*
(Continued)

*Primary Examiner* — Dominick L Plakkoottam
*Assistant Examiner* — Paul W Thiede
(74) *Attorney, Agent, or Firm* — Fish & Richardson P.C.

(57) ABSTRACT

A scroll compressor includes a discharge guide disposed in a high-pressure part to guide refrigerant discharged from a compression part to a refrigerant discharge pipe, and the discharge guide may extend by a preset height from an inner circumferential surface of a casing constituting the high-pressure part toward one side surface of a high and low pressure separation plate. This can guide discharge refrigerant discharged to the high-pressure part to quickly flow to the refrigerant discharge pipe before being spread in an entire space of the high-pressure part, thereby preventing the high and low pressure separation plate from being overheated by discharge refrigerant of high temperature. This can result in preventing suction refrigerant of a low-pressure part from being heated by heat of discharge refrigerant
(Continued)

transferred through the high and low pressure separation plate, thereby reducing a specific volume of the suction refrigerant and improving compressor efficiency.

20 Claims, 25 Drawing Sheets

(51) Int. Cl.

| | |
|---|---|
| ***F04C 29/12*** | (2006.01) |
| ***F01C 1/02*** | (2006.01) |
| ***F01C 21/00*** | (2006.01) |
| ***F01C 21/18*** | (2006.01) |

(52) U.S. Cl.
CPC ..... *F01C 1/0215* (2013.01); *F01C 21/007* (2013.01); *F04C 18/0261* (2013.01); *F04C 2240/30* (2013.01); *F04C 2240/40* (2013.01); *F04C 2240/80* (2013.01); *F04C 2240/806* (2013.01); *F04C 2270/20* (2013.01)

(58) Field of Classification Search
CPC .... F04C 2270/20; F01C 21/18; F01C 1/0215; F01C 21/007
See application file for complete search history.

(56) References Cited

U.S. PATENT DOCUMENTS

| | | | | |
|---|---|---|---|---|
| 2016/0298885 | A1 | 10/2016 | Boepker et al. | |
| 2016/0305430 | A1* | 10/2016 | Mahure | F01C 21/10 |
| 2020/0158110 | A1* | 5/2020 | Cho | F04C 18/0261 |
| 2022/0333598 | A1* | 10/2022 | Yu | F04C 18/0261 |

FOREIGN PATENT DOCUMENTS

| | | |
|---|---|---|
| JP | H10220382 | 8/1998 |
| JP | H11201060 | 7/1999 |
| KR | 1019970062348 | 9/1997 |
| KR | 100516490 | 11/2005 |
| KR | 20150126499 | 11/2015 |
| KR | 20210021877 | 3/2021 |

OTHER PUBLICATIONS

English Machine Translation of CN212389518U translated via USPTO Fit Datebase (Year: 2021).*
KR Office Action in Korean Appln. No. 10-2021-0169214, dated Nov. 23, 2022, 25 pages (with English translation).
Extended European Search Report in European Appln. No. 22205305.0, dated Apr. 3, 2023, 9 pages.

* cited by examiner

SCROLL COMPRESSOR INCLUDING DISCHARGE GUIDE TO QUICKEN DISCHARGE REFRIGERANT FLOW MOVEMENT

CROSS-REFERENCE TO RELATED APPLICATION

Pursuant to 35 U.S.C. § 119(a), this application claims the benefit of the earlier filing date and the right of priority to Korean Patent Application No. 10-2021-0169214, filed on Nov. 30, 2021, the contents of which are incorporated by reference herein in their entirety.

TECHNICAL FIELD

The present disclosure relates to a scroll compressor, and more particularly, a scroll compressor in which an inside of a casing is divided into a low-pressure part and a high-pressure part.

BACKGROUND

Scroll compressors may be classified into a high-pressure scroll compressor and a low-pressure scroll compressor according to a refrigerant suction path. In the high-pressure scroll compressor, a refrigerant suction pipe is directly connected to a suction pressure chamber, so that refrigerant is guided directly into a compression chamber without passing through an inner space of a casing. In the low-pressure scroll compressor, an inner space of a casing is divided into a low-pressure part constituting a suction pressure chamber and a high-pressure part constituting a discharge pressure chamber, and a refrigerant suction pipe communicates with the inner space of the casing constituting the low-pressure part. Accordingly, suction refrigerant of low temperature is guided into a compression chamber through the inner space of the casing.

In some low-pressure scroll compressors, suction refrigerant can partially flow through the low-pressure part and cool down a driving motor installed in the low-pressure part, thereby improving compressor efficiency. However, in the low-pressure scroll compressor, the suction refrigerant is increased in temperature due to a contact with the driving motor and then suctioned into the compression chamber. This may increase a specific volume of the suction refrigerant, thereby causing suction loss.

In addition, in these low-pressure scroll compressors, while suction refrigerant in contact with a driving motor as well as suction refrigerant without being in contact with the driving motor is suctioned into the suction pressure chamber, the suction refrigerants are heated by heat transferred through a high and low pressure separation plate. This may cause an increase in specific volume and an occurrence of suction loss. This results from that the high and low pressure separation plate is exposed to the high-pressure part of high temperature and heated by heat of the high-pressure part, and such heat is transferred from the heated high and low pressure separation plate to the relatively cold low-pressure part.

Accordingly, in the related art, some low-pressure scroll compressors having a suction conduit in a low-pressure part of a casing has been proposed. In these compressors, the suction conduit is disposed between a refrigerant suction pipe and a suction port to guide refrigerant passing through the refrigerant suction pipe directly to a compression chamber, thereby suppressing the suction refrigerant from being overheated. Here, since an inlet of the suction conduit as in these compressors is spaced apart from the refrigerant suction pipe, some of the refrigerant passing through the refrigerant suction pipe are allowed to be introduced into the low-pressure part of the casing before being suctioned into the compression chamber.

However, in the compressors described above, the inlet of the suction conduit is formed to face an outlet of the refrigerant suction pipe, and thus most of the refrigerant passing through the refrigerant suction pipe is suctioned into the compression chamber through the suction conduit. As a result, an amount of refrigerant introduced into the low-pressure part of the casing may be greatly decreased, which may deteriorate a cooling effect of a driving motor. This may narrow an operation region due to overheating of the driving motor. In addition, in the compressors described above, the high and low pressure separation plate is heated by high-temperature discharge refrigerant discharged to the high-pressure part, and suction refrigerant in the low-pressure part is heated by the heated high and low pressure separation plate, thereby increasing a specific volume and lowering compressor efficiency.

Accordingly, in the prior art, a technology in which a discharge duct or discharge guide is disposed in a high-pressure part to guide discharge refrigerant, which is to be discharged to the high-pressure part, to a refrigerant discharge pipe before spreading to the entire high-pressure part is proposed.

For example, the discharge duct or the discharge guide surrounds a through hole of the high and low pressure separation plate on an upper surface of the high and low pressure separation plate. Accordingly, the refrigerant discharged to the high-pressure part through the through hole of the high and low pressure separation plate can rapidly move to the refrigerant discharge pipe by the discharge duct or the discharge guide. This can prevent the high and low pressure separation plate from being heated by discharge refrigerant. This can prevent suction refrigerant from being heated, thereby improving efficiency of the compressor.

However, in the configurations described above, since the discharge duct or the discharge guide is coupled to the upper surface of the high and low pressure separation plate, there is a problem of increasing the number of processes for manufacturing and assembling the discharge duct or the discharge guide.

In addition, the discharge duct or discharge guide should be made of a material that can secure strength to tolerate discharge pressure in consideration of the discharge pressure of the high-pressure part. At the same time, the discharge duct or discharge guide is coupled to the high and low pressure separation plate. However, when the discharge duct or the discharge guide is made of metal, a surface area of the high and low pressure separation plate increases and the high and low pressure separation plate may be heated. Therefore, it is difficult to select a material of the discharge duct or the discharge guide in consideration of the high and low pressure separation plate.

In addition, since the discharge duct or the discharge guide surrounds, in a covering manner, the through hole of the high and low pressure separation plate defining a discharge passage, discharge refrigerant flows too quickly out of the high-pressure part. This drastically reduces a pressure pulsation reduction effect in the high-pressure part, which may cause an increase in vibration of the compressor and a system connected with the compressor. This may further require a separate vibration reduction device.

SUMMARY

The present disclosure describes a scroll compressor that is capable of enhancing compressor efficiency by suppressing an increase in specific volume of suction refrigerant.

The present disclosure also describes a scroll compressor that is capable of suppressing a high and low pressure separation plate from being overheated, to thus prevent suction refrigerant from being heated due to the high and low pressure separation plate.

The present disclosure further describes a scroll compressor that is capable of minimizing a contact between refrigerant discharged to a high-pressure part and a high and low pressure separation plate, to thus prevent the high and low pressure separation plate from being overheated.

The present disclosure further describes a scroll compressor that is capable of allowing refrigerant discharged to a high-pressure part to quickly move to a refrigerant discharge pipe, to thus minimize a contact between the refrigerant discharged to the high-pressure part and a high and low pressure separation plate.

The present disclosure further describes a scroll compressor that is capable of allowing discharge refrigerant to quickly move to a refrigerant discharge pipe and preventing an increase in surface area of a high and low pressure separation plate.

The present disclosure further describes a scroll compressor that is capable of suppressing a high and low pressure separation plate from being overheated by discharge refrigerant and preventing a reduction of a pressure pulsation reduction effect in a discharge space.

The present disclosure further describes a scroll compressor that is capable of allowing discharge refrigerant to quickly move to a refrigerant discharge pipe and sufficiently utilizing a discharge space.

The present disclosure further describes a scroll compressor that is capable of allowing discharge refrigerant to quickly move to a refrigerant discharge pipe, sufficiently utilizing a discharge space, and reducing flow resistance of the discharge refrigerant.

The present disclosure further describes a scroll compressor that is capable of preventing overheating of a high and low pressure separation plate due to discharge refrigerant.

The present disclosure further describes a scroll compressor that is capable of preventing a contact between suction pressure and a high and low pressure separation plate.

The present disclosure further describes a scroll compressor that is capable of allowing suctioned refrigerant to move toward a driving motor while blocking the same from flowing toward a high and low pressure separation plate.

In order to achieve those aspects and other advantages of the present disclosure, there is provided a scroll compressor that may include a casing, a compression part, and a high and low pressure separation plate. A refrigerant suction pipe and a refrigerant discharge pipe may be connected to the casing. The compression part may be disposed in an inner space of the casing, and configured to compress refrigerant in a compression chamber between a non-orbiting scroll and an orbiting scroll by receiving rotational force of a motor part through a rotating shaft. The high and low pressure separation plate may be disposed in one side of the compression part in an axial direction, may be divided into a low-pressure part connected to the refrigerant discharge pipe and a high-pressure part connected to the refrigerant discharge pipe, and may include a through hole formed through a central portion thereof to guide refrigerant discharged from the compression part toward the high-pressure part. The high-pressure part may be provided with a discharge guide to guide the refrigerant discharged from the compression part to the refrigerant discharge pipe. The discharge guide may extend by a preset height from at least one of an inner circumferential surface of the casing constituting the high-pressure part and one side surface of the high and low pressure separation plate facing the same toward an opposite side. This can guide discharge refrigerant discharged to the high-pressure part to quickly flow to the refrigerant discharge pipe before being spread in an entire space of the high-pressure part, thereby preventing the high and low pressure separation plate from being heated by discharge refrigerant of high temperature. This can result in preventing suction refrigerant of a low-pressure part from being heated by heat of discharge refrigerant transferred through the high and low pressure separation plate, thereby reducing a specific volume of suction refrigerant and improving compressor efficiency.

In one example, the discharge guide may have an axial end coupled to or extending from the casing, and another axial end open to be spaced apart from the high and low pressure separation plate. This can increase tolerance for a gap between the discharge guide and the high and low pressure separation plate, which can facilitate manufacturing of the upper cap including the discharge guide. In addition, an increase in surface area of the high and low pressure separation plate can be prevented by the discharge guide, which may result in further preventing heating of the high and low pressure separation plate.

Specifically, the discharge guide may extend to surround a periphery of the through hole, and a portion of the discharge guide may be open toward the refrigerant discharge pipe. With this configuration, instead of blocking a side far from the refrigerant discharge pipe, discharge refrigerant can be guided toward the refrigerant discharge pipe along the discharge guide. Accordingly, refrigerant discharged to the high-pressure part can be quickly discharged out of the compressor.

In another example, the high and low pressure separation plate may include an inclined surface portion extending from a central portion to a rim thereof to be downwardly inclined, and a first protrusion protruding from a middle portion of the inclined surface portion in a circumferential direction and extending in a radial direction. The discharge guide may be formed to be blocked between the first protrusion and the through hole and to be open between the refrigerant discharge pipe and the through hole. This can prevent discharge refrigerant from moving to a space which does not serve as a muffler space in the high-pressure part, thereby preventing a pressure pulsation reduction effect from being lowered while guiding discharge refrigerant to be quickly discharged into the refrigerant discharge pipe.

Specifically, the refrigerant discharge pipe may be connected to the casing so as to face the inclined surface portion from an opposite side of the first protrusion. The discharge guide may be formed to intersect with a first center line that passes through an axial center of the rotating shaft and extend in a longitudinal direction of the refrigerant discharge pipe. With this configuration, discharge refrigerant can be guided to the refrigerant discharge pipe by the discharge guide.

In addition, the discharge guide may be formed to be symmetrical with respect to the first center line. With this configuration, both ends of the discharge guide may be located on a straight line with a longitudinal direction of the refrigerant discharge pipe, so that discharge refrigerant can be uniformly guided to the both ends of the discharge guide, thereby enabling the discharge refrigerant to be discharged more quickly through the refrigerant discharge pipe.

In addition, the first protrusion may be formed eccentrically in a circumferential direction with respect to the first center line, and the discharge guide may be formed to be asymmetric with respect to the first center line. This can minimize a length of the discharge guide and also prevent movement of discharge refrigerant to a periphery of the first protrusion, thereby securing a pressure pulsation reduction effect for the discharge refrigerant and effectively preventing the high and low pressure separation plate from being heated.

In another example, the high and low pressure separation plate may include an inclined surface portion extending from a central portion to a rim thereof to be downwardly inclined, a first protrusion protruding from a middle of the inclined surface portion in a circumferential direction toward a radial inner circumferential surface of the casing, and a second protrusion protruding from an upper end of the inclined surface portion toward an axial inner circumferential surface of the casing to surround the through hole. The discharge guide may overlap the second protrusion in the axial direction and extend into an arcuate shape along the second protrusion. This can minimize a contact area of the high and low pressure separation plate that is in contact with discharge refrigerant, and secure a discharge area of the high-pressure part to minimize discharge resistance of the refrigerant, thereby preventing reduction in efficiency of the compressor due to the discharge guide.

Specifically, the discharge guide may have an arcuate length that is longer than or equal to an arcuate length of the first protrusion. This can prevent discharge refrigerant from moving into a space that does not serve as a substantial muffler space, thereby suppressing heating of the high and low pressure separation plate and reduction of a pressure pulsation effect.

In another example, the discharge guide may obliquely extend on each of both sides of a first center line in a spaced manner, and here, the first center line may pass through an axial center of the rotating shaft and extend in a longitudinal direction of the refrigerant discharge pipe. This can minimize a length of the discharge guide, so that discharge refrigerant can be guided to the refrigerant discharge pipe via a shortest distance, so as to be discharged more quickly.

Specifically, the high and low pressure separation plate may include an inclined surface portion extending from a central portion to a rim thereof to be downwardly inclined, a first protrusion protruding from a middle of the inclined surface portion in a circumferential direction toward a radial inner circumferential surface of the casing, and a second protrusion protruding from an upper end of the inclined surface portion toward an axial inner circumferential surface of the casing to surround the through hole. The discharge guide may extend across the second protrusion so that one end is located more inward than the second protrusion and another end is located more outward than the second protrusion. With the configuration, a portion of the discharge guide can be located closer to the radial inner circumferential surface of the upper cap constituting the high-pressure part, so as to minimize discharge refrigerant from flowing from an outer end of the discharge guide to an opposite side of the refrigerant discharge pipe.

In another example, the discharge guide may be provided in plurality disposed radially at preset distances. This can minimize that discharge refrigerant flows through the discharge guide to be spread to an entire space of the high-pressure part. Accordingly, the discharge refrigerant can be guided quickly toward the refrigerant discharge pipe, thereby effectively preventing overheating of the high and low pressure separation plate. This can also increase a surface area of the upper cap including the discharge guide, such that heat can be quickly dissipated from the discharge refrigerant, thereby preventing the overheating of the high and low pressure separation plate.

Specifically, the plurality of discharge guides may be formed such that a first axial gap between a discharge guide adjacent to the through hole and the high and low pressure separation plate is longer than a second axial gap between another discharge guide far apart from the through hole and the high and low pressure separation plate. With the configuration, a discharge volume can be secured in the vicinity of the through hole of the high and low pressure separation plate so as to minimize discharge resistance, the discharge guide can be formed in a multi-stepped shape, and discharge refrigerant can quickly move toward the refrigerant discharge pipe.

The plurality of discharge guides may be disposed such that an axial gap is constantly maintained between each of the discharge guides and the high and low pressure separation plate. This can more effectively suppress discharge refrigerant from flowing through the gaps between the discharge guides and the high and low pressure separation plate, and more increase a surface area of the discharge guide.

The plurality of discharge guides may be formed such that a first radial gap between discharge guides adjacent to the through hole is longer than a second radial gap between discharge guides far apart from the through hole. With the configuration, a discharge volume can be secured in the vicinity of the through hole of the high and low pressure separation plate so as to minimize discharge resistance, the discharge guide can be formed in a multi-stepped shape, and discharge refrigerant can quickly move toward the refrigerant discharge pipe.

A circumferential passage having both ends open may be defined between the plurality of discharge guides, to communicate with a radial passage passing through the discharge guide in a radial direction. With the configuration, the discharge guide can be formed in a multi-stepped shape, and discharge refrigerant can move more quickly to the refrigerant discharge pipe through the radial passage and the circumferential passage.

Specifically, a discharge guide located at an outermost side among the discharge guides may be seamlessly formed along a circumferential direction to block the radial passage. When the discharge guide is formed in the multi-stepped shape, discharge refrigerant can more quickly move to the refrigerant discharge pipe through the radial passage and the circumferential passage, and some of discharge refrigerant that leaks out of the discharge guide can be minimized.

The discharge guide may include a fixed plate portion coupled to the casing, and a plurality of blocking portions extending from the fixed plate portion toward the high and low pressure separation plate. Accordingly, when there are a plurality of discharge guides, they can be easily coupled to the casing.

In another example, the discharge guide may have an axial end coupled to or extending from one side surface of the high and low pressure separation plate, and another axial end open to be spaced apart from an axial inner circumferential surface of the casing. With the configuration, the discharge guide can be molded at the same time of manufacturing the high and low pressure separation plate, which can facilitate manufacturing the casing as well as the discharge guide.

Specifically, the high and low pressure separation plate may include an inclined surface portion extending from a central portion to a rim thereof to be downwardly inclined, a first protrusion protruding from a middle of the inclined surface portion in a circumferential direction toward a radial inner circumferential surface of the casing, and a second protrusion protruding from an upper end of the inclined surface portion toward an axial inner circumferential surface of the casing to surround the through hole. The discharge guide may extend integrally from the second protrusion toward the axial inner circumferential surface of the casing so as to be blocked from the first protrusion and open toward the refrigerant discharge pipe. This can facilitate the discharge guide to be formed on the high and low pressure separation plate and simultaneously minimize an increase in surface area of the high and low pressure separation plate by the discharge guide.

The high and low pressure separation plate may further be provided with a discharge guide groove recessed axially by a predetermined depth from a middle of the second protrusion in the circumferential direction. The discharge guide groove may be formed at a position intersecting with a first center line that passes through an axial center of the rotating shaft and extends in a longitudinal direction of the refrigerant discharge pipe. This can allow discharge refrigerant to be smoothly guided toward the refrigerant discharge pipe without greatly increasing a height of the discharge guide.

In another example, the scroll compressor may further include an insulation cover made of an insulating material and disposed on one axial side surface of the high and low pressure separation plate constituting the high-pressure part. As an insulation unit is formed on the high and low pressure separation plate, the high and low pressure separation plate can be more effectively prevented from being heated by discharge refrigerant. Also, the discharge guide can be minimized, which can increase a volume of the high-pressure part, thereby enhancing a pressure pulsation reduction effect.

Specifically, the insulation cover may be in close contact with one side surface of the high and low pressure separation plate constituting the high-pressure part, and may be provided with a separation-preventing portion formed uneven between the insulation cover and the high and low pressure separation plate. As the discharge cover is in close contact with the high and low pressure separation plate, deformation of the insulation cover due to discharge pressure of the high-pressure part can be suppressed, thereby increasing assembly reliability of the insulation cover.

In another example, the scroll compressor may further include an insulation cover disposed on one axial side surface of the high and low pressure separation plate constituting the high-pressure part. The insulation cover may be spaced apart from one side surface of the high and low pressure separation plate, such that an insulation space is defined between the one axial side surface of the high and low pressure separation plate and one side surface of the insulation cover facing the same. A support protrusion may be formed by extending from one of the one axial side surface of the high and low pressure separation plate and the one side surface of the insulation cover toward an opposite surface facing the same. As the insulation space is further defined in addition to the provision of the insulation cover, an insulation effect can be enhanced, and also a wide selection range for a material of the insulation cover can be provided, thereby lowering a manufacturing cost even though the insulation cover is added. Also, the discharge guide can be minimized, which can increase a volume of the high-pressure part, thereby increasing a pressure pulsation reduction effect.

In another example, an insulation layer made of an insulating material may be applied or coated on one axial side surface of the high and low pressure separation plate. This can facilitate formation of an insulation unit for the high and low pressure separation plate while enhancing an insulation effect of the high and low pressure separation plate. Also, the discharge guide can be minimized, which can increase a volume of the high-pressure part, thereby increasing a pressure pulsation reduction effect.

In another example, the refrigerant discharge pipe may be connected through an inner circumferential surface of the casing, and at least a portion thereof may axially overlap the through hole of the high and low pressure separation plate. This can reduce a distance between the through hole and the refrigerant discharge pipe which define a discharge passage, so as to minimize the discharge passage of refrigerant discharged to the high-pressure part, so that discharge refrigerant can be rapidly moved to the refrigerant discharge pipe and discharged.

Specifically, the high and low pressure separation plate may include an inclined surface portion extending from a central portion to a rim thereof to be downwardly inclined, a first protrusion protruding from a middle of the inclined surface portion in a circumferential direction toward a radial inner circumferential surface of the casing, and a second protrusion protruding from an upper end of the inclined surface portion toward an axial inner circumferential surface of the casing to surround the through hole. The refrigerant discharge pipe may be inserted through the casing on the same axis as the through hole. This can minimize a distance between the through hole and the refrigerant discharge pipe which define a discharge passage, so that refrigerant discharged to the high-pressure part can be discharged more quickly.

In another example, the scroll compressor may further include a suction guide integrally formed with or assembled to a non-orbiting scroll constituting the compression part between the high and low pressure separation plate and the non-orbiting scroll, to guide refrigerant suctioned into the low-pressure part to be suctioned into the compression chamber. The suction guide may include a suction guide protrusion extending integrally from an outer circumferential surface of the non-orbiting scroll toward the inner circumferential surface of the casing, and a suction guide passage formed through an inside of the suction guide protrusion such that the low-pressure part and the compression chamber communicate with each other. The suction guide protrusion may be configured such that an outer wall surface radially facing the inner circumferential surface of the casing or the inner circumferential surface of the high and low pressure separation plate, side wall surfaces extending from both sides of the outer wall surface in the circumferential direction, and an upper wall surface connecting the outer wall surface and the side wall surfaces and facing an axial inner surface of the high and low pressure separation plate are all formed in a closed shape. A lower wall surface facing the refrigerant suction pipe and an inner wall surface facing the compression chamber may be open. With the configuration, suction refrigerant flowing into the low-pressure part of the casing through the refrigerant suction pipe can be prevented from being heated by heat transferred through the high and low pressure separation plate. In addition, as some of the suction refrigerant are guided toward a driving motor to cool the driving motor, motor efficiency can be enhanced and an operation range of the compressor can be expanded. Also, the discharge guide can be minimized, which can increase a volume of the high-pressure part, thereby increasing a pressure pulsation reduction effect. In addition, even if the insulation cover or the insulation layer is provided, the insulation cover or the insulation layer can be minimized, thereby reducing a manufacturing cost.

Specifically, the outer wall surface of the suction guide protrusion may be radially spaced apart from the inner circumferential surface of the casing or the inner circumferential surface of the high and low pressure separation plate. This can suppress suction refrigerant from being heated by discharge heat or welding heat transferred through the casing or the high and low pressure separation plate while passing through the suction guide, thereby more reducing a specific volume of the suction refrigerant.

DETAILED DESCRIPTION

Description will now be given in detail of a scroll compressor according to one implementation disclosed herein, with reference to the accompanying drawings. As aforementioned, scroll compressors may be classified into a high-pressure scroll compressor and a low-pressure scroll compressor according to a path along which refrigerant is suctioned. Hereinafter, a low-pressure scroll compressor in which an inner space of a casing is divided into a low-pressure part and a high-pressure part by a high/low pressure separation plate and a refrigerant suction pipe communicates with the low-pressure part will be described as an example.

In addition, scroll compressors may be classified into a vertical scroll compressor in which a rotation shaft is disposed perpendicular to the ground and a horizontal scroll compressor in which a rotation shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the present disclosure may also be equally applied to the horizontal scroll compressor. Therefore, hereinafter, an axial direction may be understood as an axial direction of a rotating shaft, and a radial direction may be understood as a radial direction of the rotating shaft. The axial direction may be understood as a vertical direction, and the radial direction may be understood as left and right surfaces.

In addition, scroll compressors may be classified into a non-orbiting scroll back pressure type (hereinafter, a fixed-scroll back pressure type) in which a non-orbiting scroll is pressed toward an orbiting scroll, and an orbiting scroll back pressure type (hereinafter, an orbiting-scroll back pressure type) in which the orbiting scroll is pressed toward the non-orbiting scroll. Hereinafter, a scroll compressor according to a fixed-scroll back pressure type will be mainly described. However, the present disclosure may also be equally applied to the orbiting-scroll back pressure type.

Figure 1:
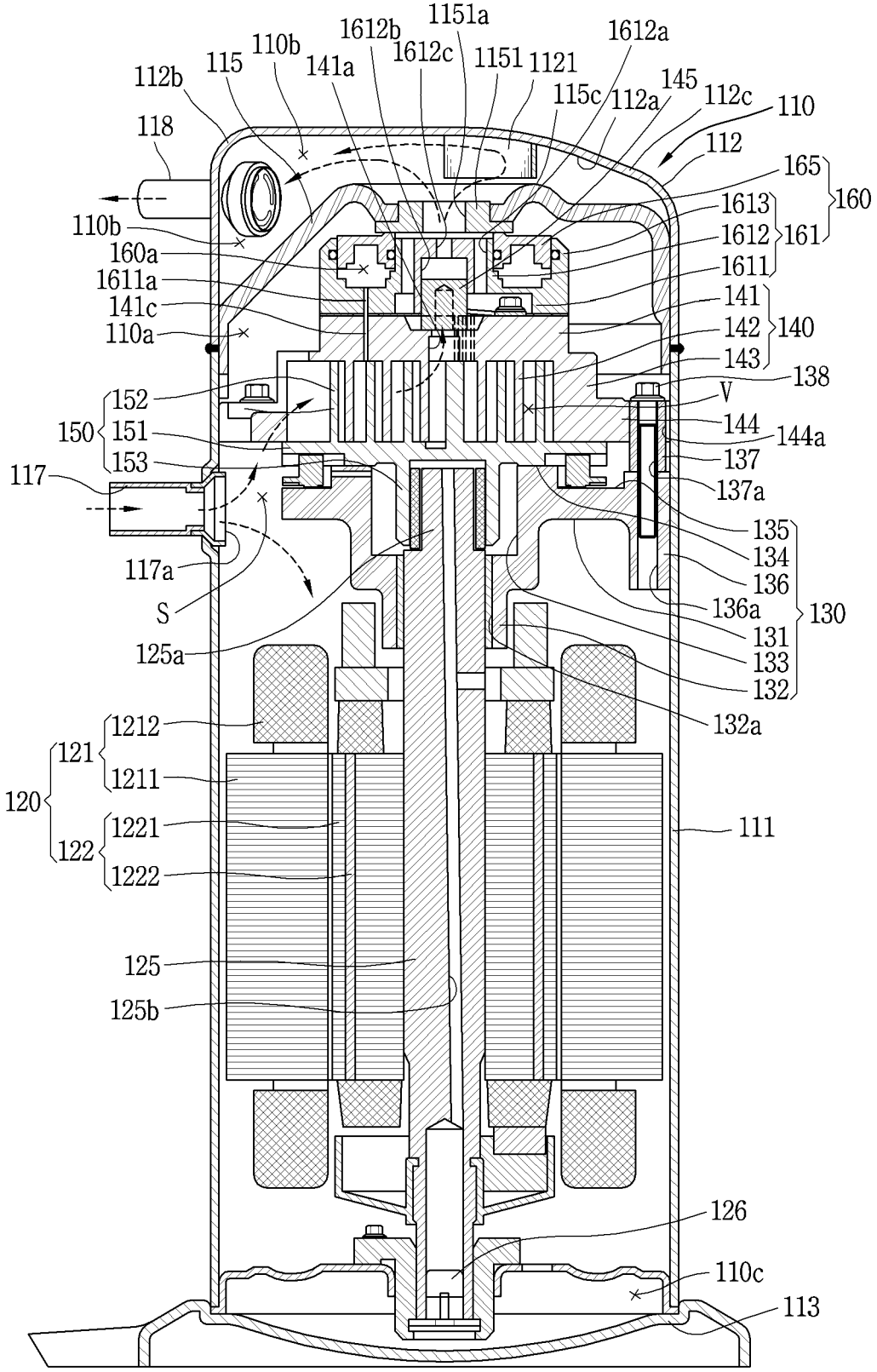
FIG. 1 is a longitudinal sectional view illustrating an inner structure of a scroll compressor in accordance with an implementation.
Figure 2:
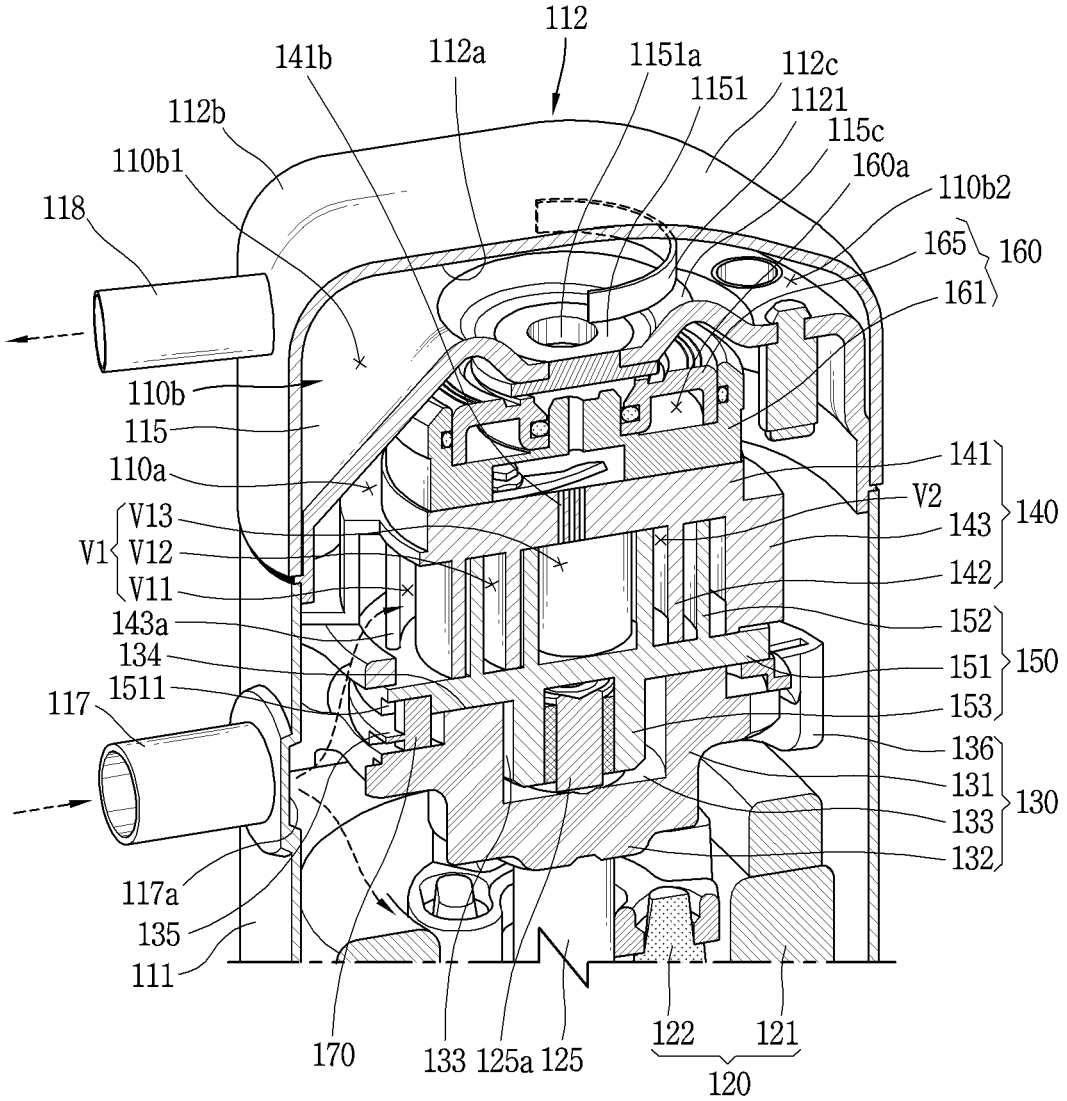
FIG. 2 is a cutout perspective view illustrating a portion of a compression part in FIG. 1.

FIG. 1 is a longitudinal sectional view illustrating an inner structure of a scroll compressor in accordance with an implementation and FIG. 2 is a cutout perspective view illustrating a portion of a compression part in FIG. 1.

Referring to FIGS. 1 to 2, a scroll compressor according to an implementation may include a driving motor 120 disposed in a lower half portion of a casing 110, and a main frame 130, an orbiting scroll 150, a non-orbiting scroll 140, and a discharge pressure chamber assembly 160 that are sequentially disposed at an upper side of the driving motor 120. In general, the driving motor 120 may constitute a motor part, and the main frame 130, the orbiting scroll 150, the non-orbiting scroll 140, and the back pressure chamber assembly 160 may constitute a compression part. The motor part may be coupled to one end of a rotation shaft 125, and the compression part may be coupled to another end of the rotation shaft 125. Accordingly, the compression part may be connected to the motor part by the rotation shaft 125 to be operated by a rotational force of the motor part.

The casing 110 may include a cylindrical shell 111, an upper cap 112, and a lower cap 113.

The cylindrical shell 111 may have a cylindrical shape with upper and lower ends open, and the driving motor 120 and the main frame 130 may be fitted on an inner circumferential surface of the cylindrical shell 111. A terminal bracket (not shown) may be coupled to an upper portion of the cylindrical shell 111, and a terminal (not shown) for transmitting external power to the driving motor 120 may be coupled through the terminal bracket. In addition, a refrigerant suction pipe 117 to be explained later may be coupled to the upper portion of the cylindrical shell 111, for example, above the driving motor 120.

The upper cap 112 may be coupled to cover the opened upper end of the cylindrical shell 111, and the lower cap 113 may be coupled to cover the opened lower end of the cylindrical shell 111. A rim of a high and low pressure separation plate 115 to be explained later may be inserted between the cylindrical shell 111 and the upper cap 112 to be welded to the cylindrical shell 111 and the upper cap 112, and a rim of a support bracket 116 to be explained later may be inserted between the cylindrical shell 111 and the lower cap 113 to be welded to the cylindrical shell 111 and the lower cap 113. Accordingly, the inner space of the casing 110 may be sealed.

The rim of the high and low pressure separation plate 115, as aforementioned, may be welded to the casing 110 and a central portion of the high and low pressure separation plate 115 may be disposed at an upper side of a back pressure chamber assembly 160 which will be explained later and defines a compression part. A refrigerant suction pipe 117 may communicate with a space below the high/low pressure separation plate 115, and a refrigerant discharge pipe 118 may communicate with a space above the high and low pressure separation plate 115. Accordingly, the low-pressure part 110*a* constituting a suction space may be formed below the high/low pressure separation plate 115, and a high-pressure part 110*b* constituting a discharge space may be formed above the high/low pressure separation plate 115. The high and low pressure separation plate 115 will be described later in detail together with the upper cap 112.

The refrigerant suction pipe 117 may be coupled through the cylindrical shell 111 in the radial direction, and the outlet 117*a* of the refrigerant suction pipe 117 may be disposed to face the compression part. For example, the outlet 117*a* of the refrigerant suction pipe 117 may be located between main flange portions 131 of the main frame 130 to be described later. Accordingly, some of refrigerant suctioned into the low-pressure part 110*a* through the refrigerant suction pipe 117 may move upward to be directly suctioned into the compression chamber V, while the remaining refrigerant may move down toward the motor part to cool down the driving motor 120 constituting the motor part.

The refrigerant discharge pipe 118 may be coupled through the upper cap 112 in the radial direction. The outlet 117*a* of the refrigerant suction pipe 117 may be located to face an outer surface of the high and low pressure separation plate 115, more precisely, disposed between an inner circumferential surface of the upper cap 112 and an outer circumferential surface of the high and low pressure separation plate 115. Accordingly, the refrigerant passing through a high/low pressure communication hole 1151*a* of a sealing plate 1151 to be described later may flow along the outer circumferential surface of the high/low pressure separation plate 115 and then flow out of the compressor through the refrigerant discharge pipe 118.

In addition, a through hole 115*d* to be explained later may be formed through a center of the high/low pressure separation plate 115, and a sealing plate 1151 to which a floating plate 165 to be described later is detachably coupled may be inserted into the through hole 115*d*. Accordingly, the low-pressure part 110*a* and the high-pressure part 110*b* may be blocked from or communicate with each other by attachment and detachment of the floating plate 165 and the sealing plate 1151. The high and low pressure separation plate 115 will be described later together with the upper cap 112.

The sealing plate 1151 may be formed in an annular shape. For example, the high/low pressure communication hole 1151*a* may be formed through a center of the sealing plate 1151 so that the low-pressure part 110*a* and the high-pressure part 110*b* communicate with each other. The floating plate 165 may be attachable and detachable along a circumference of the high/low pressure communication hole 1151*a*. Accordingly, the floating plate 165 may be attached to or detached from the circumference of the high/low pressure communication hole 1151*a* of the sealing plate 1151 while moving up and down by back pressure in an axial direction. During this process, the low-pressure part 110*a* and the high-pressure part 110*b* may be sealed from each other or communicate with each other.

In addition, the lower cap 113 may define an oil storage space 110*c* together with the lower portion of the cylindrical shell 111 constituting the low-pressure part 110*a*. In other words, the oil storage space 110*c* may be defined in the lower portion of the low-pressure part 110*a*. The oil storage space 110*c* may define a part of the low-pressure part 110*a*.

Hereinafter, the driving motor will be described.

Referring to FIG. 1, the driving motor 120 according to the implementation may be disposed in the lower portion of the low-pressure part 110*a* and include a stator 121 and a rotor 122. The stator 121 may be shrink-fitted to an inner wall surface of the casing 110, and the rotor 122 may be rotatably provided inside the stator 121.

The stator 121 may include a stator core 1211 and a stator coil 1212.

The stator core 1211 may be formed in a cylindrical shape and may be shrink-fitted onto the inner circumferential surface of the cylindrical shell 111. The stator coil 1212 may be wound around the stator core 1211 and may be electrically connected to an external power source through a terminal (not shown) that is coupled through the casing 110.

The rotor 122 may include a rotor core 1221 and permanent magnets 1222.

The rotor core 1221 may be formed in a cylindrical shape, and may be rotatably inserted into the stator core 1211 with a preset gap therebetween. The permanent magnets 1222 may be embedded in the rotor core 1221 at preset distances along a circumferential direction.

The rotating shaft 125 may be coupled to the center of the rotor 122. An upper end portion of the rotating shaft 125 may be rotatably inserted into the main frame 130 to be described later so as to be supported in a radial direction, and a lower end portion of the rotating shaft 125 may be rotatably inserted into the support bracket 116 to be supported in the radial and axial directions. The main frame 130 may be provided with a main bearing supporting the upper end portion of the rotating shaft 125, and the support bracket 116 may be provided with a sub bearing supporting the lower end portion of the rotating shaft 125. The main bearing and the sub bearing each may be configured as a bush bearing.

An eccentric portion 125*a* that is eccentrically coupled to the orbiting scroll 150 to be explained later may be formed on the upper end portion of the rotating shaft 125, and an oil pickup 126 for absorbing oil stored in the lower portion of the casing 110 may be disposed in the lower end portion of the rotating shaft 125. An oil passage 125*b* may be formed through the rotation shaft 125 in the axial direction.

Next, the main frame will be described.

The main frame 130 according to this implementation may be disposed above the driving motor 120 and may be shrink-fitted or welded to an inner wall surface of the cylindrical shell 111.

Referring to FIGS. 1 and 2, the main frame 130 may include a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure part 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 to be explained later may protrude from the outer circumferential surface of the main flange portion 131 in the radial direction, and an outer circumferential surface of the frame fixing portion 136 may be brought into close contact with and fixed to the inner circumferential surface of the casing 110. Accordingly, the frame 130 can be fixedly coupled to the casing 110.

The main bearing portion 132 may protrude downward from a lower surface of a central part of the main flange portion 131 toward the driving motor 120. The main bearing portion 132 may be provided with a bearing hole 132*a* formed therethrough in a cylindrical shape along an axial direction, and the main bearing configured as the bush bearing may be fixedly coupled to an inner circumferential surface of the bearing hole 132*a* in an inserted manner. The rotating shaft 125 may be inserted into the main bearing to be supported in the radial direction.

The orbiting space portion 133 may recessed from the center part of the main flange portion 131 toward the main bearing portion 132 to a predetermined depth and outer diameter. The outer diameter of the orbiting space portion 133 may be larger than an outer diameter of a rotation shaft coupling portion 153 that is disposed on the orbiting scroll 150 to be described later. Accordingly, the rotation shaft coupling portion 153 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 151 to be described later in the axial direction.

The Oldham ring support portion 135 may be formed in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may be formed to extend radially from an outer periphery of the Oldham ring supporting portion 135. The frame fixing portion 136 may extend in an annular shape or may extend to form a plurality of protrusions spaced apart from one another by preset distances. This implementation illustrates an example in which the frame fixing portion 136 has a plurality of protrusions along the circumferential direction.

For example, the plurality of frame fixing portions 136 may be disposed to face guide protrusions 154 of the non-orbiting scroll 140 to be described later in the axial direction. Bolt coupling holes 136*a* corresponding to guide insertion holes 144*a* to be explained later in the axial direction may be axially formed through the frame fixing portions 136.

An inner diameter of the bolt coupling hole 136*a* may be smaller than an inner diameter of the guide insertion hole 144*a*. Accordingly, a stepped surface extending from an inner circumferential surface of the guide insertion hole 144*a* may be formed on a periphery of an upper surface of the bolt coupling hole 136*a*, and a guide bush 137 that is inserted through the guide insertion hole 144*a* may be placed on the stepped surface so as to be supported on the frame fixing portion 136 in the axial direction.

The guide bush 137 may be formed in a hollow cylindrical shape through which a bolt insertion hole 137*a* is formed in the axial direction. A guide bolt 138 may be inserted through the bolt insertion hole 137*a* of the guide bush 137 to be coupled to the bolt coupling hole 136*a* of the frame fixing portion 136. The non-orbiting scroll 140 may thus be slidably supported on the main frame 130 in the axial direction and fixed to the main frame 130 in the radial direction.

On the other hand, the frame fixing portions 136 may be formed at preset distances along the circumferential direction, and a kind of suction guide space (S may be defined between the frame fixing portions 136 facing each other in the circumferential direction). Accordingly, a refrigerant suctioned into the low-pressure part 110a may be guided to a suction guide 190 to be described later through the suction guide space S between the adjacent frame fixing portions 136. Accordingly, refrigerant suctioned into the low-pressure part 110a through the refrigerant suction pipe 117 may be separated while passing through the suction guide space, so that some move to the compression chamber V and the other moves toward the driving motor 120.

Hereinafter, the non-orbiting scroll will be described.

Referring to FIGS. 1 and 2, the non-orbiting scroll 140 according to the implementation may be disposed on an upper part of the main frame 130 with interposing the orbiting scroll 150 therebetween. The non-orbiting scroll 140 may be fixedly coupled to the main frame 130 or may be coupled to the main frame 130 to be movable up and down. The implementation illustrates an example in which the non-orbiting scroll 140 is coupled to the main frame 130 to be movable relative to the main frame 130 in the axial direction.

The non-orbiting scroll 140 according to this implementation may include a non-orbiting end plate 141, a non-orbiting wrap 143, a non-orbiting side wall portion 143, and a guide protrusion 144.

The non-orbiting end plate 141 may be formed in a disk shape and disposed in a horizontal direction in the low-pressure part 110*a* of the casing 110. A discharge port 141*a*, a bypass hole 141*b*, and a scroll-side back pressure hole 141*c* may be formed through the central portion of the non-orbiting end plate 141 in the axial direction.

The discharge port 141*a* may be located at a position where a discharge pressure chamber (no reference numeral given) of the first compression chamber V1 and a discharge pressure chamber (no reference numeral given) of the second compression chamber V2 communicate with each other. The bypass hole 141*b* may communicate with the first compression chamber V1 and the second compression chamber V2, respectively. The scroll-side back pressure hole (hereinafter, first back pressure hole) 141*c* may be formed by being spaced apart from the discharge port 141*a* and the bypass hole 141*b*.

The non-orbiting wrap 142 may extend from a lower surface of the non-orbiting end plate 141 facing the orbiting scroll 150 by a preset height in the axial direction. Here, the non-orbiting wrap 142 may extend to be spirally rolled plural times toward the non-orbiting side wall portion 143 around the outlet 117*a*. The non-orbiting wrap 142 may be formed to correspond to an orbiting wrap 152 to be described later, so as to define a pair of compression chambers V1 and V2 with the orbiting wrap 152.

The non-orbiting side wall portion 143 may extend in an annular shape from a rim of a lower surface of the non-orbiting end plate 141 in the axial direction. A suction port 143*a* may be formed through one side of an outer circumferential surface of the non-orbiting side wall portion 143 in the radial direction.

For example, the suction port 143*a* may be formed in an arc shape that extends by a preset length between a plurality of guide protrusions 144 to be described later in the circumferential direction. Accordingly, refrigerant suctioned through the refrigerant suction pipe 117 may be rapidly suctioned into the suction port 143*a* via the guide protrusions 144.

The guide protrusion 144 may extend radially from an outer circumferential surface of a lower side of the non-orbiting side wall portion 143. The guide protrusion 144 may be formed in a single annular shape or may be provided in plurality disposed at preset distances in the circumferential direction. This implementation will be mainly described with respect to an example in which the plurality of guide protrusions 144 are disposed at preset distances along the circumferential direction.

Guide insertion holes 144*a* may be formed through the plurality of guide protrusions 144 in the axial direction, respectively. The guide insertion holes 144*a* may be disposed on the same axis as the bolt coupling holes 136*a* disposed in the frame fixing portions 136 of the main frame 130. Accordingly, the guide bush 137 can be inserted through the guide insertion hole 144*a* to be supported on the upper surface of the frame fixing portion 136 in the axial direction.

Hereinafter, the orbiting scroll will be described.

The orbiting scroll 150 according to the implementation may be coupled to the rotating shaft 125 and disposed on an upper surface of the main frame 130. An Oldham ring 170, which is an anti-rotation mechanism, may be provided between the orbiting scroll 140 and the main frame 130 so that the orbiting scroll 140 performs an orbiting motion.

Referring to FIGS. 1 and 2, the orbiting scroll 150 according to the implementation may include an orbiting end plate 151, an orbiting wrap 152, and a rotating shaft coupling portion 153.

The orbiting end plate 151 may be formed approximately in a disk shape. The orbiting end plate 151 may be supported on the scroll support portion 134 of the main frame 130 in the axial direction.

The orbiting wrap 152 may be formed in a spiral shape by protruding from an upper surface of the orbiting end plate 151 facing the non-orbiting scroll 140 to a preset height. The orbiting wrap 152 may be formed to correspond to the non-orbiting wrap 142 to perform an orbiting motion by being engaged with a non-orbiting wrap 142 of the non-orbiting scroll 140 to be described later. The orbiting wrap 152 may define a compression chamber V together with the non-orbiting wrap 142.

The compression chamber V may include a first compression chamber V1 and a second compression chamber V2 based on the non-orbiting wrap 142. The first compression chamber V1 may be formed at an outer surface of the non-orbiting wrap 152, and the second compression chamber V2 may be formed at an inner surface of the non-orbiting wrap 152. Each of the first compression chamber V1 and the second compression chamber V2 may include a suction pressure chamber V11, an intermediate pressure chamber V12, and a discharge pressure chamber V13 that are continuously formed.

The rotating shaft coupling portion 153 may protrude from a lower surface of the orbiting end plate 151 toward the main frame 130. The rotating shaft coupling portion 153 may be formed in a cylindrical shape, and an eccentric portion bearing 173 may be coupled to an inner circumferential surface of the rotating shaft coupling portion 153 in an inserted manner. The eccentric portion bearing 173 may be configured as a bush bearing.

Meanwhile, as described above, the Oldham ring 170 may be provided between the main frame 130 and the orbiting scroll 150 to restrict a rotational motion of the orbiting scroll 150. The Oldham ring 170 may be slidably coupled to the main frame 130 and the orbiting scroll 140, or slidably coupled to the orbiting scroll 140 and the non-orbiting scroll 150. In this implementation, an example in which the Oldham ring 170 is slidably inserted into the non-orbiting scroll 140 and the orbiting scroll 150 will be described.

Next, the back pressure chamber assembly will be described.

Referring to FIGS. 1 and 2, the back pressure chamber assembly 160 according to the implementation may be disposed at an upper side of the non-orbiting scroll 140. Accordingly, back pressure of a back pressure chamber 160*a* (to be precise, force that the back pressure acts on the back pressure chamber) may be applied to the non-orbiting scroll 140. In other words, the non-orbiting scroll 140 may be pressed toward the orbiting scroll 150 by the back pressure to seal the compression chamber V.

In detail, the back pressure chamber assembly 160 may include a back pressure plate 161, and a floating plate 165. The back pressure plate 161 may be coupled to the upper surface of the non-orbiting end plate 141 and the floating plate 165 may be slidably coupled to the back pressure plate 161 to define a back pressure chamber 160*a* together with the back pressure plate 161.

The back pressure plate 161 may include a fixed end plate portion 1611, a first annular wall portion 1612, and a second annular wall portion 1613.

The fixed plate portion 1611 may be formed in an annular plate shape with a hollow center, and a plate-side back pressure hole (hereinafter, referred to as a second back pressure hole) 1611*a* may be formed through the fixed plate portion 1611 in the axial direction. The second back pressure hole 1611*a* may communicate with the first back pressure hole 141*c* so as to communicate with the back pressure chamber 160*a*. Accordingly, the compression chamber V and the back pressure chamber can communicate with each other through the second back pressure hole 1611*a* together with the first back pressure hole 141*c*.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape can be defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may be provided with an intermediate discharge port 1612*a* communicating with the discharge port 141*a* of the non-orbiting scroll 140, a valve guide groove 1612*b* in which a check valve 145 is slidably inserted may be formed in the intermediate discharge port 1612*a,* and a backflow prevention hole 1612*c* may be formed in a central portion of the valve guide groove 1612*b*. Accordingly, the check valve 145 may selectively be opened and closed between the discharge port 141*a* and the intermediate discharge port 1612*a* to suppress a discharged refrigerant from flowing back into the compression chamber.

The floating plate 165 may be formed in an annular shape and may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on pressure of the back pressure chamber 160*a*. For example, when the floating plate 165 is brought into contact with the high/low pressure separation plate 115, the floating plate 165 may serve to seal the low-pressure part 110*a* such that the discharged refrigerant is discharged to the high-pressure part 110*b* without leaking into the low-pressure part 110*a*.

The scroll compressor according to the implementation of the present disclosure may operate as follows.

That is, when power is applied to the stator coil 121*a* of the stator 121, the rotor 122 may rotate together with the rotation shaft 125. Then, the orbiting scroll 150 coupled to the rotation shaft 125 may perform the orbiting motion with respect to the non-orbiting scroll 140, thereby forming a pair of compression chambers V between the orbiting wrap 152 and the non-orbiting wrap 142. The compression chamber V may gradually decrease in volume while moving from outside to inside according to the orbiting motion of the orbiting scroll 150.

At this time, the refrigerant may be sucked into the low-pressure part 110*a* of the casing 110 through the refrigerant suction pipe 117. A part of this refrigerant may be sucked directly into the suction pressure chambers V11 of the first compression chamber V1 and the second compression chamber V2, respectively, while the rest of the refrigerant may first flow toward the driving motor 120 and then be sucked into the suction pressure chambers V11. This will be described again later.

Then, the refrigerant may be compressed while moving along a movement path of the compression chamber V. A part of the compressed refrigerant may move toward the back pressure chamber 160*a* through the first back pressure hole 141*c* before reaching the discharge port 141*a*. Accordingly, the back pressure chamber 160*a* formed by the non-orbiting end plate 161 and the floating plate 165 may form intermediate pressure.

Then, the floating plate 165 may rise toward the high/low pressure separation plate 115 to be brought into close contact with the sealing plate 1151 provided on the high/low pressure separation plate 115. Then, the high-pressure part 110*b* of the casing 110 may be separated from the low-pressure part 110*a,* to prevent the refrigerant discharged from each compression chamber V1 and V2 from flowing back into the low-pressure part 110*a*.

On the other hand, the back pressure plate 161 may be lowered by pressure of the back pressure chamber 160*a* applied toward the non-orbiting scroll 140, so as to press the non-orbiting scroll 140 toward the orbiting scroll 150. Accordingly, the non-orbiting scroll 140 may be closely adhered on the orbiting scroll 150 to prevent the compressed refrigerant from leaking from the high-pressure side compression chamber, which forms an intermediate pressure chamber, to a low-pressure side compression chamber.

Then, some of the refrigerant moving from the intermediate pressure chamber to the discharge pressure chamber may be bypassed in advance from the intermediate pressure chamber forming each compression chamber V1 and V2 toward the high-pressure part 110*b* through the bypass hole 141*b* before reaching the discharge pressure chamber. Then, the refrigerant can be prevented from being excessively compressed over the preset pressure in the compression chamber V, thereby enhancing efficiency of the compressor and ensuring stability of the compressor.

The refrigerant moved to the discharge pressure chamber may be discharged to the high-pressure part 110b through the discharge port 141*a* and the intermediate discharge port 1612*a* while pushing the discharge valve 145. The refrigerant may be filled in the high-pressure part 110*b* and then flow out through a condenser of a refrigeration cycle via the refrigerant discharge pipe 118. The series of processes may be repetitively carried out. At this time, pressure pulsation of discharge refrigerant discharged to the high-pressure part 110*b* may be generated. However, a space defining the high-pressure part 110b serves as a kind of muffler space, so that the pressure pulsation of the discharge refrigerant is attenuated and vibration of the compressor is reduced.

Meanwhile, the refrigerant discharged to the high-pressure part 110*b* may be in a high-temperature and high-pressure state. The refrigerant in the high-temperature and high-pressure state may be brought into contact with an axial inner circumferential surface (hereinafter, also referred to as a lower surface) 112*a* of the upper cap 112 and an axial side surface (hereinafter, upper surface) (no reference numeral) of the high and low pressure separation plate 115 constituting the high-pressure part 110*b,* thereby heating the upper cap 112 and the high and low pressure separation plate 115. In particular, as the high/low pressure separation plate 115 serves to divide the inner space of the casing 110 into the low-pressure part 110*a* and the high-pressure part 110*b,* the temperature of the high/low pressure separation plate 115 may be remarkably increased by the refrigerant discharged to the high-pressure part 110*b* during the operation of the compressor.

When the temperature of the high/low pressure separation plate 115 is increased, suction refrigerant suctioned into the low-pressure part 110*a* may partially be brought into contact with the high/low pressure separation plate 115 before being suctioned into the compression chamber V, so as to receive conductive heat or be heated by radiant heat generated from the high/low pressure separation plate 115. Then, a specific volume of the suction refrigerant may increase, thereby reducing an amount of refrigerant suctioned into the compression chamber and lowering compressor efficiency.

Accordingly, in this implementation, refrigerant discharged from the compression part to the high-pressure part is discharged as quickly as possible, so that the contact of the high-temperature refrigerant with the high and low pressure separation plate can be minimized. This can suppress an increase in specific volume of refrigerant suctioned into the compression chamber and thus increase an amount of refrigerant suctioned into the compression chamber, thereby improving efficiency of the compressor.

In addition, in this implementation, suction refrigerant can be allowed to partially move toward the driving motor. Accordingly, some of the suction refrigerant can be guided toward the driving motor 120 so as to prevent overheating of the driving motor 120, thereby further improving the efficiency of the compressor and simultaneously preventing a reduction of an operation-available region (operation range) due to the overheat of the driving motor 120.

Figure 3:
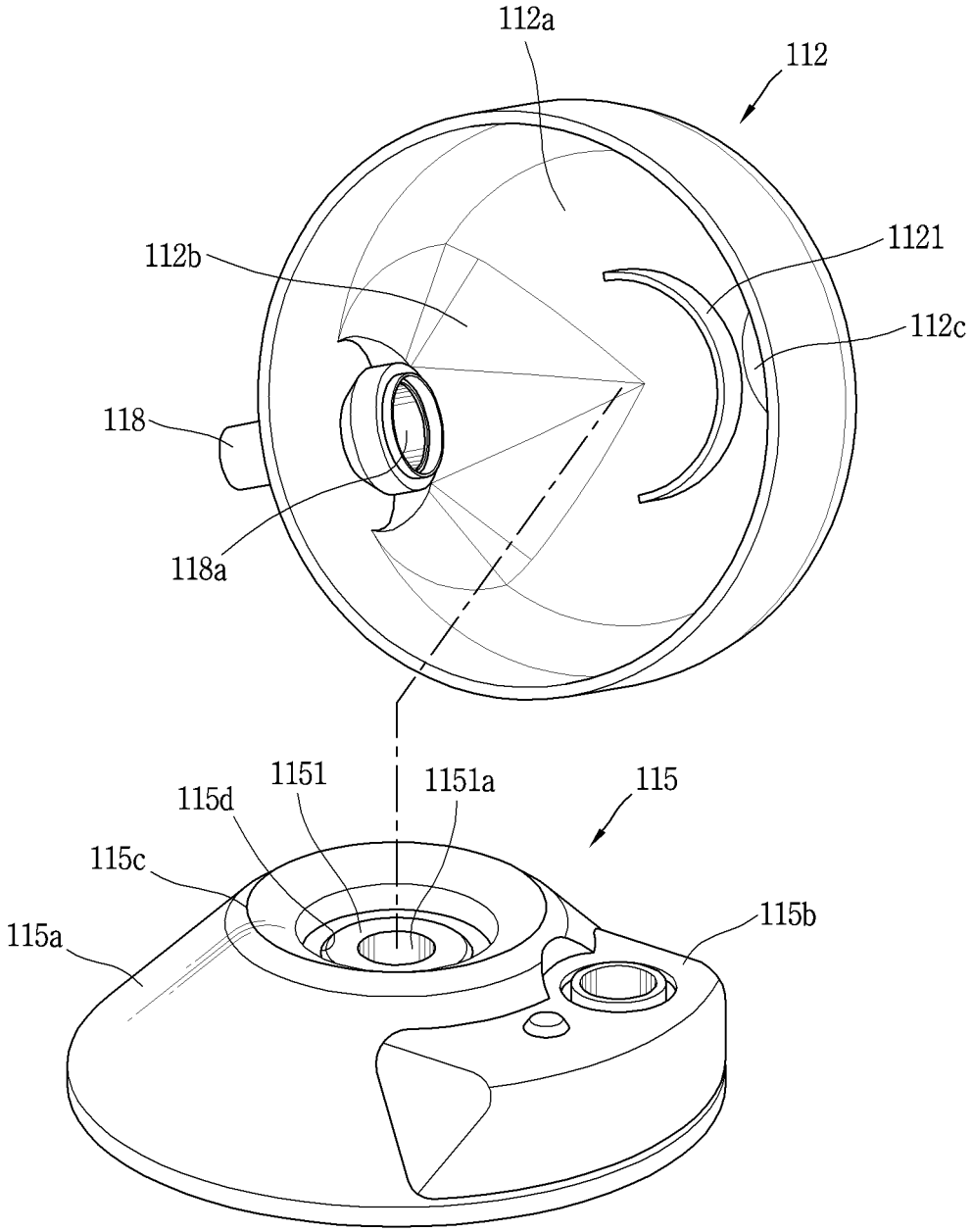
FIG. 3 is an exploded perspective view illustrating a high and low pressure separation plate and a lower cap in FIG. 1.
Figure 4:
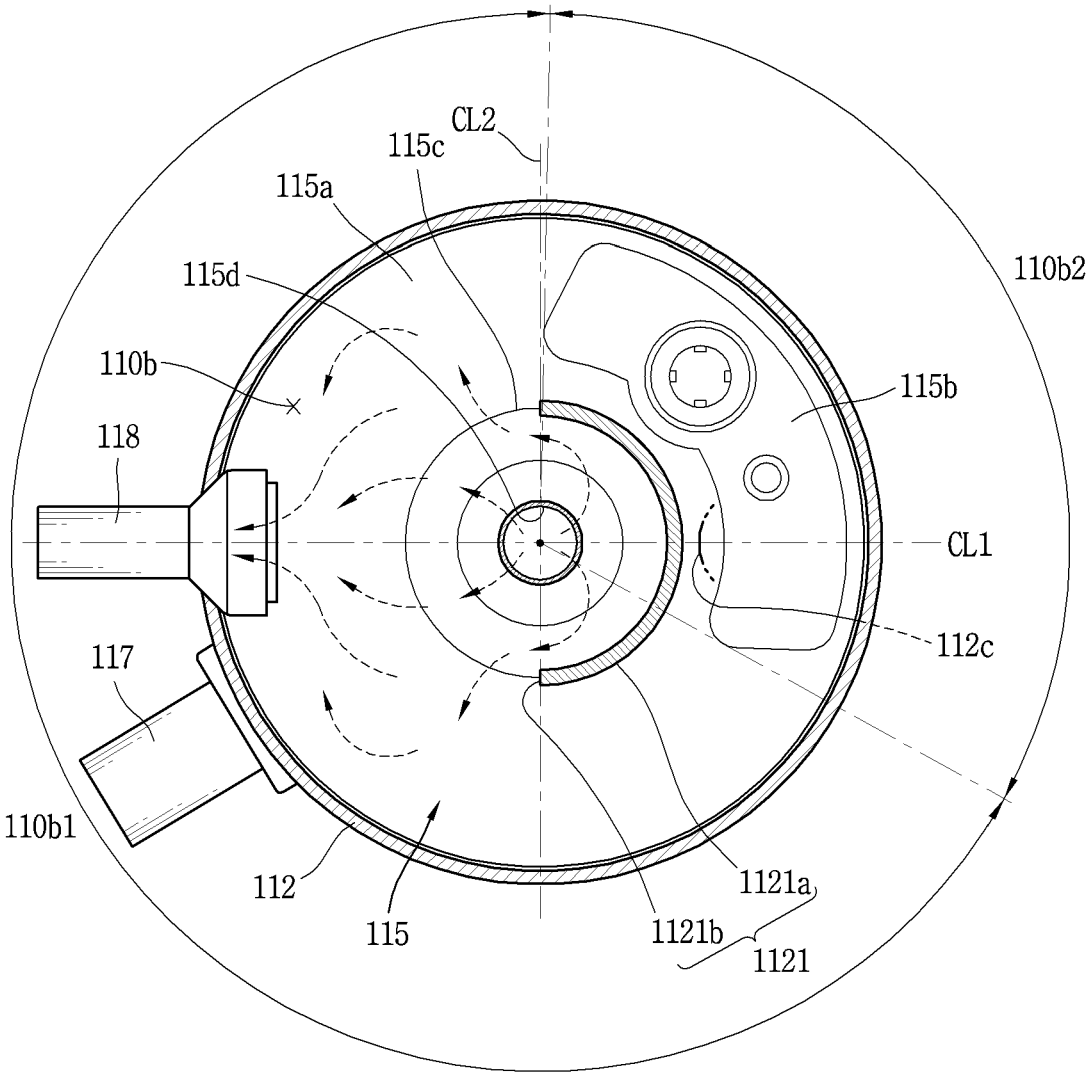
FIG. 4 is an assembled horizontal sectional view of the high and low pressure separation plate and the lower cap in FIG. 3.
Figure 5:
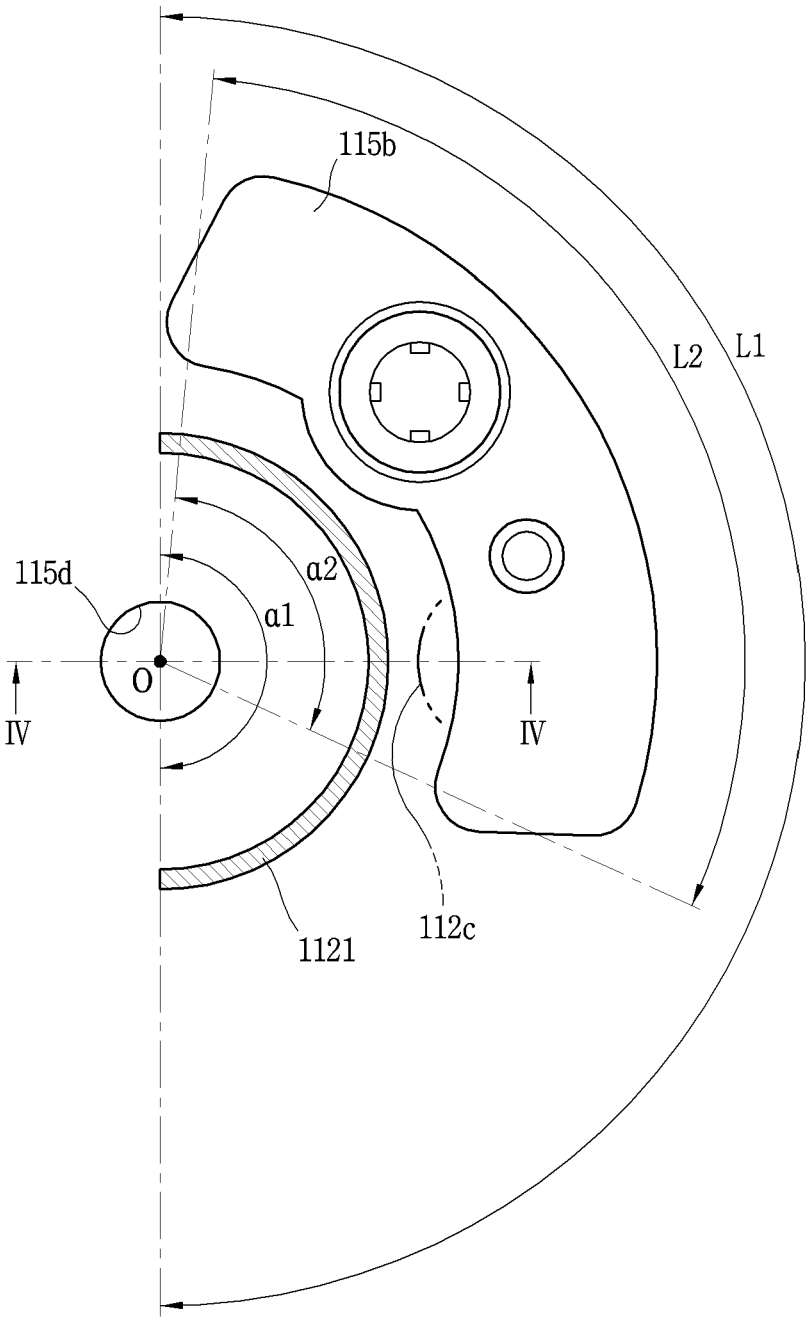
FIG. 5 is an enlarged schematic view illustrating a surrounding of a discharge guide in FIG. 4.
Figure 6:
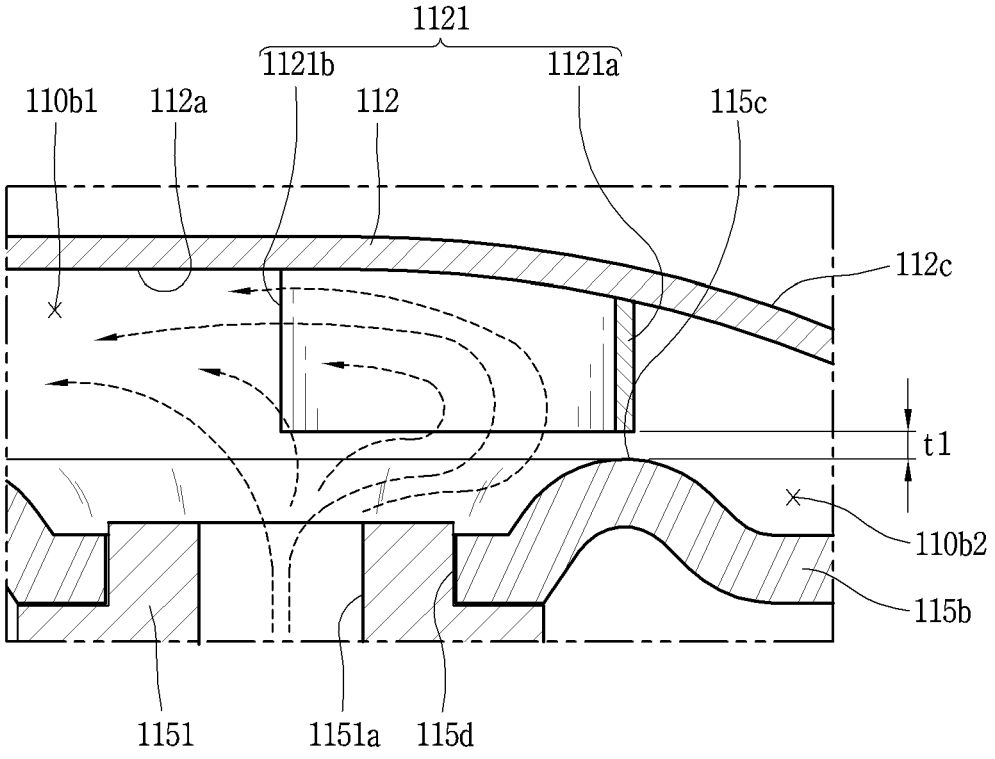
FIG. 6 is a cross-sectional view taken along the line "IV-IV" of FIG. 5.

FIG. 3 is an exploded perspective view illustrating a high and low pressure separation plate and a lower cap in FIG. 1, FIG. 4 is an assembled horizontal sectional view of the high and low pressure separation plate and the lower cap in FIG. 3, FIG. 5 is an enlarged schematic view illustrating a surrounding of a discharge guide in FIG. 4, and FIG. 6 is a cross-sectional view taken along the line "IV-IV" of FIG. 5.

Referring to FIGS. 1 and 3, in the scroll compressor according to this implementation, the upper cap 112 may have a dome shape which is slightly convex or flat at a central portion of an upper wall, and the high and low pressure separation plate 115 may have a dome shape which is considerably convex toward the axial inner circumferential surface (lower surface) 112*a* of the upper cap 112 at a central portion of its upper wall.

For example, the upper cap 112 may be configured such that a rim connecting a side wall and the upper wall thereof is curved with substantially the same curvature. Here, an extended protrusion 112*b* which extends radially long to be flatter than other portions may be formed on one side of the rim of the upper cap 112. A reduced surface portion 112*c* may be formed at an opposite side of the extended protrusion 112*b* to be gently inclined downward from the central portion toward the rim. Accordingly, a first space portion 110*b*1 having a relatively large volume of the high-pressure part 110*b* may be defined inside the extended protrusion 112*b*, and a second space portion 110*b*2 having a relatively small volume of the high-pressure part 110*b* may be defined inside the reduced surface portion 112*c*.

Referring to FIGS. 3 to 6, the high and low pressure separation plate 115 may be configured such that its rim is lower than an upper surface of the back pressure chamber assembly 160 and its central portion is higher than the upper surface of the back pressure chamber assembly 160. For example, the high and low pressure separation plate 115 may include an inclined surface portion 115*a*, a radial protrusion (hereinafter, referred to as a first protrusion) 115*b*, an axial protrusion (hereinafter, referred to as a second protrusion) 115*c*, and a through hole 115*d*.

The inclined surface portion 115*a* is inclined downward from the central portion defining a periphery of an inner circumferential surface of the high and low pressure separation plate 115 toward a rim defining an outer circumferential surface thereof. Accordingly, the high and low pressure separating plate 115 may be configured such that the second protrusion 115*c* and the inclined surface portion 115*a*, except for the first protrusion 115*b*, form a substantially frusto-conical shape. With the configuration, the first space portion 110*b*1 which substantially defines a muffler space may be widely formed in the high-pressure part 110*b* between the inclined surface portion 115*a* of the high and low pressure separation plate 115 and the inner circumferential surface of the upper cap 112 facing the same.

The first protrusion 115*b* protrudes radially at a middle of the inclined surface portion 115*a* in the circumferential direction. The first protrusion 115*b* is a portion for installing an overheat prevention unit and/or a pressure control valve (no reference numeral), and extends radially from the outer circumferential surface of the second protrusion 115*c* to form a plate shape. Accordingly, the first protrusion 115*b* may be referred to as a plate-shaped protrusion.

The first protrusion 115*b* is formed at a boundary surface between the inclined surface portion 115*a* and the second protrusion 115*c*. Accordingly, an upper end of the first protrusion 115*b* is slightly lower than an upper end of the second protrusion 115*c* but significantly higher than a lower end of the inclined surface portion 115*a*. A lower end of the first protrusion 115*b* is located at the same height as a lower end of the inclined surface portion 115*a*.

An outer surface of the first protrusion 115*b* is formed in the axial direction to be substantially parallel to a radial inner circumferential surface (side surface) defining the side wall of the upper cap 112. Accordingly, the outer surface of the first protrusion 115*b* is in close contact with or is in contact with little gap with the radial inner circumferential surface of the upper cap 112.

The first protrusion 115*b* is located at a position facing the reduced surface portion 112*c* of the upper cap 112 in the axial direction. In other words, the first protrusion 115*b* protrudes from the middle of the inclined surface portion 115*a* toward the reduced surface portion 112*c* of the upper cap 112. A surrounding of the first protrusion 115*b* may define the second space portion 110*b*2 of the high-pressure part 110*b* together with the reduced surface portion 112*c* of the upper cap 112. Accordingly, a volume per unit area of the second space portion 110*b*2 is extremely small compared to the first space portion 110*b*1 which is defined around the inclined surface portion 115*a* to serve as a substantial muffler space.

The refrigerant discharge pipe 118 may be inserted through the upper cap 112 at an opposite side of the first protrusion 115*b*, so as to communicate with the high-pressure part 110*b*. That is, when an imaginary line extending along a longitudinal direction of the refrigerant discharge pipe 118 and passing through an axial center O of the rotating shaft 125 is referred to as a first center line CL1 (or a longitudinal center line of the refrigerant discharge pipe) and an imaginary line orthogonal to the first center line CL1 and passing through the axial center O of the rotating shaft 125 is referred to as a second center line CL2, the first protrusion 115*b* may be located at an opposite side of the refrigerant discharge pipe 118 based on the second center line Cl2.

Specifically, the first protrusion 115*b* may be formed to be eccentric in the circumferential direction by about 30° from the first center line CL1 at the opposite side of the refrigerant discharge pipe 118 based upon the second center line CL2, and the extended protrusion 112*b* of the upper cap 112, to which the refrigerant discharge pipe 118 is connected, may be located at a position spaced apart from a center of the first protrusion 115*b* by about 150° in the circumferential direction. Accordingly, the refrigerant discharge pipe 118 can communicate with the high-pressure part 110*b* in the first space portion 110*b*1 having the greatest volume by avoiding the second space portion 110*b*2 having a small volume.

The second protrusion 115*c* is formed in the central portion of the high and low pressure separation plate 115. In other words, the second protrusion 115*c* is formed along a circumference of the through hole 115*d* at a position slightly apart from the through hole 115*d*.

The second protrusion 115*c* protrudes in an annular shape toward the lower surface 112*a* of the upper cap 112 and then is recessed toward the back pressure chamber assembly 160. Accordingly, the second protrusion 115*c* defines an annular protrusion. However, in some cases, the second protrusion 115*c* may be excluded or may be formed as an annular protrusion having a remarkably low stepped shape.

The through hole 115*d* is formed through the central portion of the high and low pressure separating plate 115, that is, through a central portion of the second protrusion 115*c*. Accordingly, the second protrusion 115*c* formed as the annular protrusion can be disposed at an outer side of the through hole 115*d*.

The sealing plate 1151, to which the floating plate 165 is detachably coupled, is inserted into the through hole 115*d* as described above, and a high and low pressure communication hole 1151*a* may be formed axially through the sealing plate 1151. Accordingly, the low-pressure part 110*a* and the high-pressure part 110*b* can substantially communicate with each other by the high and low pressure communication hole 1151*a*. Here, the sealing plate 1151 may be excluded in some cases, but the through hole 115*d* of the high and low pressure separation plate 115 is an essential component. Therefore, hereinafter, the low-pressure part 110*a* and the high-pressure part 110*b* will be described for convenience as communicating with each other through the through hole 115*d*.

Referring to FIGS. 1 to 3, a discharge guide 1121 is disposed on an axial inner circumferential surface (lower surface) 112*a* of the upper cap 112 according to this implementation. The discharge guide 1121 guides refrigerant discharged to the high-pressure part 110*b* toward the refrigerant discharge pipe 118. The discharge guide 1121 may be formed as a groove or may be formed as a protrusion. Hereinafter, an example in which the discharge guide 1121 is formed in a shape of a protrusion having a preset height toward the high and low pressure separation plate 115 will be mainly described.

Referring to FIGS. 3 to 6, the discharge guide 1121 extends from the axial inner circumferential surface (lower surface) 112*a* of the upper cap 112 toward the high and low pressure separation plate 115. The discharge guide 1121 may extend integrally from the upper cap 112, or in some cases may be separately manufactured and then assembled to the upper cap 112. In the former case, the discharge guide 1121 can be easily formed, and in the latter case, the upper cap 112 can be easily manufactured. Hereinafter, the latter case, that is, an example in which the discharge guide 1121 is separately manufactured and assembled to the upper cap 112 will be mainly described.

The discharge guide 1121 has an upper end fixed to the lower surface 112*a* of the upper cap 112, and a lower end extending in the axial direction toward the high and low pressure dividing plate 115 to be spaced apart by a preset axial distance t1 from the high and low pressure separation plate 115. A lower end of the discharge guide 1121 may be open toward the high and low pressure separation plate 115. Accordingly, the discharge guide 1121 may be formed in a shape of protrusion which is open toward the refrigerant discharge pipe 118.

Specifically, the discharge guide 1121 according to this implementation includes a blocking portion 1121*a* defining a wall surface and an open portion 1121*b* defining an outlet surface.

The blocking portion 1121*a* may extend along the second protrusion 115*c* in the circumferential direction. For example, the blocking portion 1121*a* may be formed seamlessly in a continuous arcuate shape in the circumferential direction, and may be formed to overlap the second protrusion 115*c* in the axial direction. Although not illustrated in the drawings, the blocking portion 1121*a* may be formed in a circular shape, and may partially be stepped in the axial direction so as to form the open portion 1121*b*. Hereinafter, the arcuate blocking portion 1121*a* will be mainly described.

The blocking portion 1121*a* may be formed to have a C-shaped cross-sectional shape when projected in the axial direction, and at least a portion thereof may be located on the longitudinal center line of the refrigerant discharge pipe 118, that is, on the first centerline CL1. For example, both ends of the blocking portion 1121*a* may be symmetrically formed with respect to the first center line CL1. Accordingly, both ends of the blocking portion 1121*a* can be located at the same distance from an outlet 118*a* of the refrigerant discharge pipe 118, such that refrigerant moving along the inner circumferential surface of the discharge guide 1121 can be evenly concentrated toward the refrigerant discharge pipe 118 at the both ends of the blocking portion 1121*a*.

The blocking portion 1121*a* may be formed at the same height from the upper surface of the high and low pressure separating plate 115 in the circumferential direction. For example, the blocking portion 1121*a* has almost the same axial distance t1 in the circumferential direction between the lower end of the blocking portion 1121*a* and the upper end of the second protrusion 115*c* facing the same. Accordingly, discharge refrigerant can quickly flow toward the refrigerant discharge pipe 118 as much as possible along the blocking portion 1121*a* at the inside of the discharge guide 1121 without flowing to the outside of the discharge guide 1121.

The open portion 1121*b* is formed between the both ends of the blocking portion 1121*a*. The open portion 1121*b* is open toward the refrigerant discharge pipe 118. The open portion 1121*b* may be one in number, but in some cases, may be provided in plurality disposed at preset distances along the circumferential direction. Hereinafter, a case in which the single open portion 1121*b* is formed will be mainly described.

The open portion 1121*b* may be located on the first center line CL1, and may be symmetrical with respect to the first center line CL1. Accordingly, the refrigerant moving along the blocking portion 1121*a* can quickly move to the refrigerant discharge pipe 118 through the open portion 1121*b*.

As described above, when the discharge guide 1121 is formed in the arcuate shape, it may be advantageous in terms of preventing heat transfer to the high and low pressure separation plate 115 that an arcuate length L1 of the discharge guide 1121 is as long as possible. However, if the arc length L1 of the discharge guide 1121 is too long, discharge refrigerant may flow out of the high-pressure part 110*b* too quickly, which may excessively reduce a pressure pulsation reduction effect.

For example, the discharge guide 1121 (precisely, the blocking portion of the discharge guide, but it will be described collectively as the discharge guide for convenience) is located on the first center line CL1. At this time, a central angle (hereinafter, a first central angle) $\alpha 1$ of the discharge guide 1121, which is formed by connecting the axial center O of the rotating shaft 125 based on the first center line CL1 to the both ends of the discharge guide 1121, may be greater than a central angle (hereinafter, a second central angle) $\alpha 2$ of the first protrusion 115*b*, which is formed by connecting the axial center O to both ends of the first protrusion 115*b*, for example, may be about 180°.

Here, the second central angle $\alpha 2$ of the first protrusion 115*b* is actually about 115°, but the first protrusion 115*b* is formed eccentrically by about 30° with respect to the first center line CL1. Therefore, when viewed based on the first center line CL1, it may be understood that a compensated second central angle α2' of the first protrusion 115*b* is approximately 180° in consideration of eccentricity of the first protrusion 115*b*. Accordingly, in order for the discharge guide 1121 to be symmetrical with respect to the first center line CL1 and completely cover the first protrusion 115*b*, the first central angle α1 of the discharge guide 1121 is preferably about 180° which is almost similar to the compensated second central angle α2' of the first protrusion 115*b*.

If the first central angle α1 of the discharge guide 1121 is significantly greater than the compensated second central angle α2' of the first protrusion 115*b* (e.g., greater than or equal to) 270°), the arcuate length L1 of the discharge guide 1121 which is defined as an arcuate length for the first central angle α1 becomes considerably long. Then, discharge refrigerant can rapidly move and be discharged from the high-pressure part 110*b* to the refrigerant discharge pipe 118, so as to effectively prevent the overheat of the high and low pressure separation plate 115. However, in this case, the discharge refrigerant may flow out of the high-pressure part 110*b* too quickly, which may excessively reduce the pressure pulsation reduction effect in the high-pressure part 110*b*.

On the contrary, when the first central angle α1 of the discharge guide 1121 is significantly smaller than the compensated second central angle α2' of the first protrusion 115*b*, for example, smaller than about 180°, the arcuate length L1 of the discharge guide 1121 becomes too short. Then, discharge refrigerant may flow from the both ends of the discharge guide 1121 toward an outer circumferential surface (rear side) of the discharge guide 1121, which may delay the discharge of the refrigerant from the high-pressure part 110*b*. In this case, the pressure pulsation reduction effect in the high-pressure part 110*b* may be improved but the high-low pressure separation plate 115 may be overheated.

Accordingly, in this implementation, the first central angle α1 of the discharge guide 1121 may be at least greater than or equal to the compensated second central angle α2' of the first protrusion 115*b*, for example, greater than or equal to approximately 180° (at least about 150° in consideration of inertia of discharge refrigerant), and may be as great as possible to improve a refrigerant discharge effect without drastically reducing the pressure pulsation reduction effect, for example, may be smaller than or equal to about 270°.

In other words, the arcuate length L1 of the discharge guide 1121 according to this implementation may be longer than the arcuate length L2 of the first protrusion 115*b*. Accordingly, the discharge guide 1121 can completely cover the first protrusion 115*b* even if the first protrusion 115*b* is eccentric with respect to the first center line CL1 but the discharge guide 1121 is symmetrical to the first center line CL1. This can minimize movement of discharge refrigerant to an outer space of the discharge guide 1121, namely, the second space portion 110*b*2 around the first protrusion 115*b*, thereby securing the pressure pulsation reduction effect in the high-pressure part 110*b* and minimizing the overheat of the high and low pressure separation plate 115.

Figure 7:
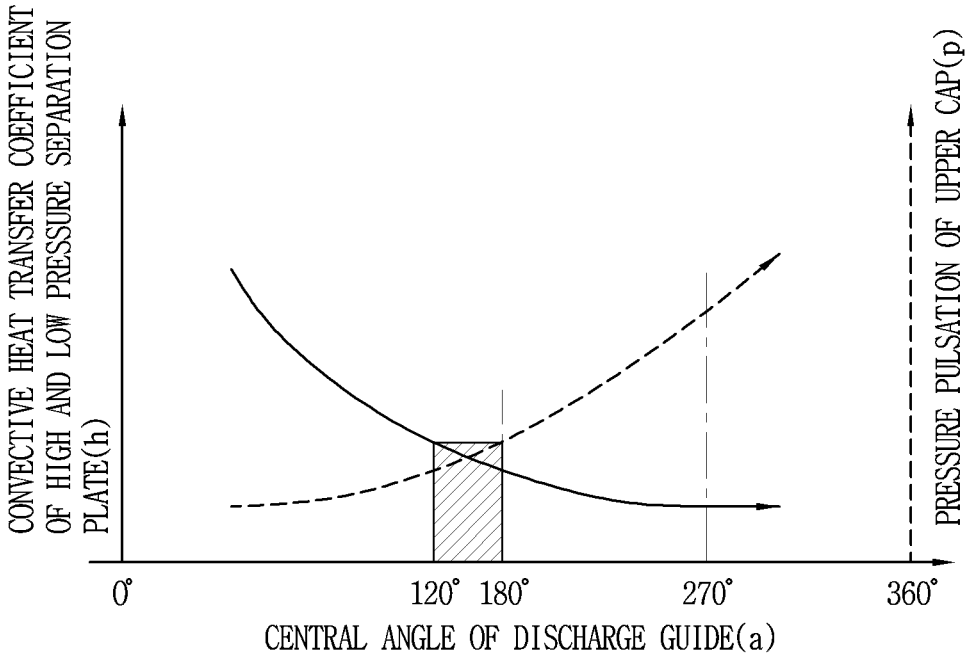
FIG. 7 is a graph showing the change in convective heat transfer coefficient and the change in pressure pulsation in a high-pressure part according to the change in central angle of a discharge guide.

This can be explained with reference to FIG. 7. FIG. 7 is a graph showing the change in convective heat transfer coefficient and the change in pressure pulsation in a high-pressure part according to the change in central angle of a discharge guide.

As shown in FIG. 7, as the central angle (first central angle) α1 of the discharge guide 1121 increases, the convective heat transfer coefficient decreases and an overheat prevention effect of the high and low pressure separation plate gradually increases. On the other hand, as the first central angle α1 of the discharge guide 1121 increases, the pressure pulsation increases and the pressure pulsation reduction effect in the high-pressure part 110*b* gradually decreases.

However, it can be seen that, when the first central angle α1 of the discharge guide 1121 is approximately 150°, the convective heat transfer coefficient (overheat prevention effect) of the high and low pressure separation plate 115 and the pressure pulsation (pressure pulsation reduction effect) of the upper cap 112 cross each other. This means that the overheat prevention effect and the pressure pulsation reduction effect are balanced with each other. Accordingly, when the arcuate discharge guide 1121 is symmetrical to the first center line CL1, the first central angle α1 of the discharge guide 1121 may preferably be formed to be approximately 150° to 210° in consideration of the inertia of the discharge refrigerant or other conditions.

In addition, since the discharge guide 1121 according to this implementation is provided to suppress the overheat of the high and low pressure separation plate 115, it may be advantageous to form the discharge guide 1121 to maximize the overheating prevention effect even if the reduction in the pressure pulsation reduction effect is taken into account to a certain extent. In this case, as shown in the graph of FIG. 7, it may be desirable that an angle at which the decrease in the convective heat transfer coefficient is slowed, that is, the central angle (first central angle) α1 of the discharge guide 1121 is approximately 270°. With the configuration, although the pressure pulsation reduction effect is somewhat reduced, the overheating of the high and low pressure separation plate 115 can be suppressed to minimize suction loss of refrigerant, thereby increasing efficiency of the compressor.

Figure 8:
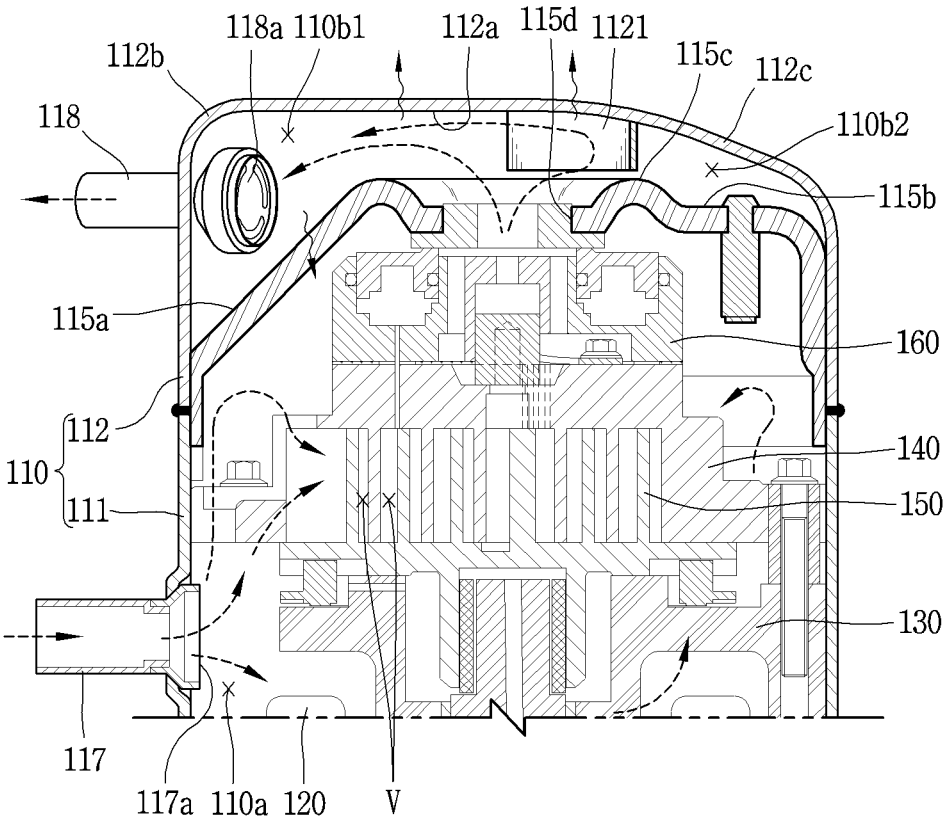
FIG. 8 is a longitudinal sectional view illustrating an effect according to a discharge guide in FIG. 1.

FIG. 8 is a longitudinal sectional view illustrating an effect according to a discharge guide in FIG. 1.

Referring to FIG. 8, when the discharge guide 1121 is disposed on the lower surface 112*a* of the upper cap 112 constituting the high-pressure part 110*b*, refrigerant discharged from the compression part can quickly move to the refrigerant discharge pipe 118 along the discharge guide 1121, so as to flow out of the compressor. This can minimize the contact between high-temperature refrigerant discharged to the high-pressure part 110*b* and the high and low pressure separation plate 115, thereby suppressing the high and low pressure separation plate 115 from being overheated.

This can prevent suction refrigerant, which is suctioned into the low-pressure part 110*a* through the refrigerant suction pipe 117, from being directly or indirectly heated by the high and low pressure separation plate 115, thereby suppressing an increase in specific volume of the suction refrigerant. As a result, an amount of refrigerant suctioned into the compression chamber V can increase, thereby improving efficiency of the compressor.

In addition, as the blocking portion 1121*a* constituting the wall surface of the discharge guide 1121 is formed far apart from the refrigerant discharge pipe 118, namely, to obscure the first protrusion 115*b* of the high and low pressure separation plate 115, the blocking portion 1121*a* can constitute the discharge guide 1121 and also keep serving as a substantial muffler for the high-pressure part 110*b*. That is, the portion where the first protrusion 115*b* of the high and low pressure separation plate 115 is formed protrudes toward the upper cap 112, so that a gap between the high and low pressure separation plate 115 and the upper cap 112 is narrowed and a volume is reduced thereby. As a result, a space in the vicinity of the first protrusion 115*b* does not sufficiently serve as a muffler space, compared to other spaces.

At this time, when the blocking portion 1121*a* as in the implementation is not disposed, refrigerant discharged from the compression part to the high-pressure part 110*b* partially moves even to the narrow space in the vicinity of the first protrusion 115*b*. As a result, the narrow space may not serve as a substantial muffler space and the high and low pressure separation plate 115 may be heated by the refrigerant. This may cause the high and low pressure separation plate 115 to be overheated faster and more.

However, when the blocking portion 1121*a* is disposed to block the periphery of the first protrusion 115*b* as in this implementation, refrigerant discharged from the compression part to the high-pressure part 110*b* can be prevented from moving to the space which does not play a substantial role of a muffler space. The provision of the discharge guide may result in effectively suppressing the high and low pressure separation plate 115 from being overheated and smoothly attenuating pressure pulsation of the refrigerant discharged from the compression part to the high-pressure part 110*b*.

In addition, when the discharge guide 1121 is integrally formed with the upper cap 112 constituting the casing, the discharge guide 1121 itself can serve as a kind of cooling fin to effectively cool the refrigerant discharged to the high-pressure part 110*b*. Accordingly, the temperature of the refrigerant discharged to the high-pressure part 110*b* can be lowered and a heat transfer rate to the high and low pressure separation plate 115 can also be lowered, thereby reducing overheating of suction refrigerant to a certain extent.

In addition, when the discharge guide 1121 is formed integrally on the upper surface 112*a* of the upper cap 112 constituting the casing 110 as in the implementation, separate components or processing may not be added so as to lower a manufacturing cost and also the high and low pressure separation plate 115 can be effectively suppressed from being overheated due to discharge refrigerant.

When the discharge guide 1121 is provided in the high-pressure part 110*b* to suppress overheating of the high and low pressure separation plate as in this implementation, discharge heat of the high-pressure part 110*b* which is transferred to the low-pressure part 110*a* can be reduced as described above. This may result in excluding from the low-pressure part 110*a* a refrigerant guide member, such as a member (e.g., a suction conduit in US Patent Application Publication No. US2016/0298885A1, the disclosure of which is incorporated herein by reference) for guiding suction refrigerant directly to the compression chamber V. As a result, some of the suction refrigerant can smoothly move to the driving motor 120 to sufficiently cool the driving motor 120, thereby preventing overheating of the driving motor 120 and thus widening an operation range of the compressor.

Hereinafter, a description will be given of another implementation of a discharge guide.

That is, the single discharge guide is provided in the previous implementation but in some cases the discharge guide may be provided in plurality.

Figure 9:
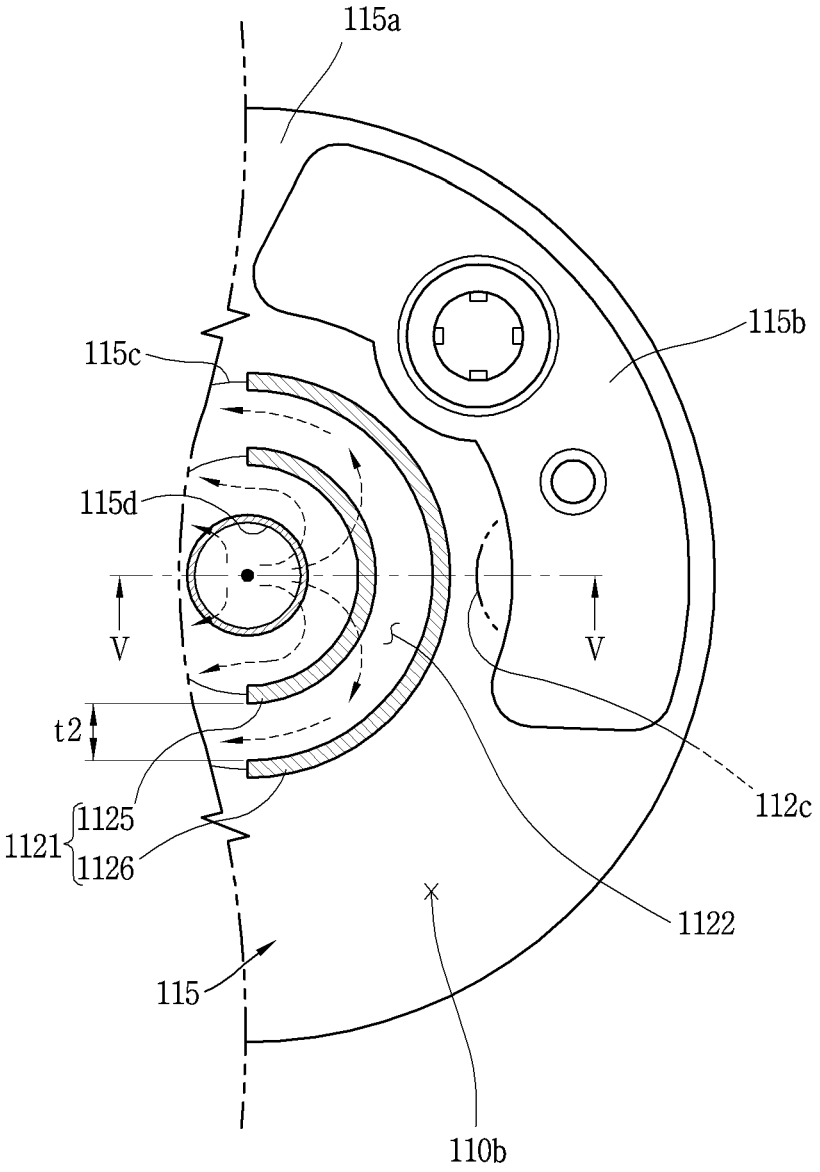
FIG. 9 is an enlarged schematic view illustrating another implementation of a discharge guide in FIG. 4.

FIG. 9 is an enlarged schematic view illustrating another implementation of a discharge guide in FIG. 4, and FIGS. 10A to 10C are sectional views taken along the line "V-V" of FIG. 9.

Referring to FIG. 9, the basic configurations of the upper cap 112 and the high and low pressure separation plate 115 according to this implementation and the operating effects thereof are the same as those in the previous implementation. In addition, since the shape, position, and direction of the discharge guide 1121 are almost similar to those of the previous implementation, a description thereof will be replaced with the description of the previous implementation.

However, the discharge guide 1121 according to this implementation may be provided in plurality, i.e., 1125 and 1126 spaced apart from each other in a radial direction, and a circumferential passage 1122 along which refrigerant can move in the circumferential direction may be defined between the plurality of discharge guides 1125 and 1126.

The plurality of discharge guides 1125 and 1126 may be spaced apart from each other by a predetermined radial distance t2, and may be formed seamlessly in a continuous arcuate shape in the circumferential direction. Accordingly, the circumferential passage 1122 may also be formed seamlessly in a continuous arcuate shape in the circumferential direction, and both ends of the circumferential passage 1122 may be open in the circumferential direction toward the refrigerant discharge pipe 118.

For example, when the plurality of discharge guides 1125 and 1126 include one inner discharge guide (hereinafter, referred to as a first discharge guide) 1125 located at an inner side and one outer discharge guide (hereinafter, referred to as a second discharge guide) 1126 located at an outer side, the first discharge guide 1125 and the second discharge guide 1126 may be formed to have the same curvature.

In other words, as illustrated in FIG. 9, the first discharge guide 1125 and the second discharge guide 1126 may have the same curvature, and in this case, the circumferential passage 1122 defined between the first discharge guide 1125 and the second discharge guide 1126 may have the same cross-sectional area along the circumferential direction.

Although not illustrated, the both discharge guides 1125 and 1126 may have different curvatures. For example, the first discharge guide 1125 and the second discharge guide 1126 may be formed such that the cross-sectional area of the circumferential passage 1122 is constant (equal) in the circumferential direction or increases or decreases toward the both ends.

When the cross-sectional area of the circumferential passage 1122 increases toward the both ends, flow resistance in the circumferential passage 1122 can be reduced. Then, refrigerant flowing between the both discharge guides 1125 and 1126 can quickly move to the refrigerant discharge pipe 118.

On the other hand, when the curvature of the first discharge guide 1125 is smaller than the curvature of the second discharge guide 1126 so that the cross-sectional area of the circumferential passage 1122 becomes smaller toward the both ends, an inner space of the first discharge guide 1125 may be widened. Accordingly, a large amount of discharge refrigerant can move quickly to the refrigerant discharge pipe 118 along the first discharge guide 1125 without moving to the circumferential passage 1122 over an inner discharge space.

Referring to FIG. 9, any one of the plurality of discharge guides 1121 may overlap the second protrusion 115*c* when projected in the axial direction or may be located more inward than the second protrusion 115*c*. For example, the first discharge guide 1125 located at the inner side may be located more inward than the second protrusion 115*c* whereas the second discharge guide 1126 located at the outer side may be located on the same axis as the second protrusion 115*c*.

When the plurality of discharge guides 1125 and 1126 are provided as described above, the refrigerant can be blocked twice. This can minimize leakage of discharge refrigerant toward the first protrusion 115*b*. In other words, some of the discharge refrigerant may leak out of the first discharge guide 1125 through an axial gap, namely, a first axial gap t11 to be explained later, between the first discharge guide 1125 and the high and low pressure separation plate 115. However, most of refrigerant leaked out of the first discharge guide 1125 is blocked by the second discharge guide 1126 located outside the first discharge guide 1125, and moves along the circumferential passage 1122 between the first discharge guide 1125 and the second discharge guide 1126 in the circumferential direction, so as to be guided toward the refrigerant discharge pipe 118. This can prevent refrigerant discharged from the compression part to the high-pressure part 110*b* from leaking into the second space portion 110*b*2, which hardly serves as the muffler space, and at the same time can allow most of the refrigerant to move to the first space portion 110*b*1 serving as the substantial muffler space. Accordingly, the refrigerant can more quickly move toward the refrigerant discharge pipe 118.

In addition, when there are the plurality of discharge guides 1121 as in this implementation, a total cross-sectional area of the discharge guide 1121 defining a heat dissipation area can increase, so that temperature of discharge refrigerant discharged to the high-pressure part 110*b* can be lowered more quickly. This can more effectively suppress the heat transfer to the high and low pressure separation plate 115.

On the other hand, the plurality of discharge guides 1125 and 1126 may be formed such that axial gaps t11 and t12 between lower ends of the respective discharge guides 1125 and 1126 and the upper surface of the high and low pressure separation plate 115 are the same or different from each other in some cases.

Figure 10A:
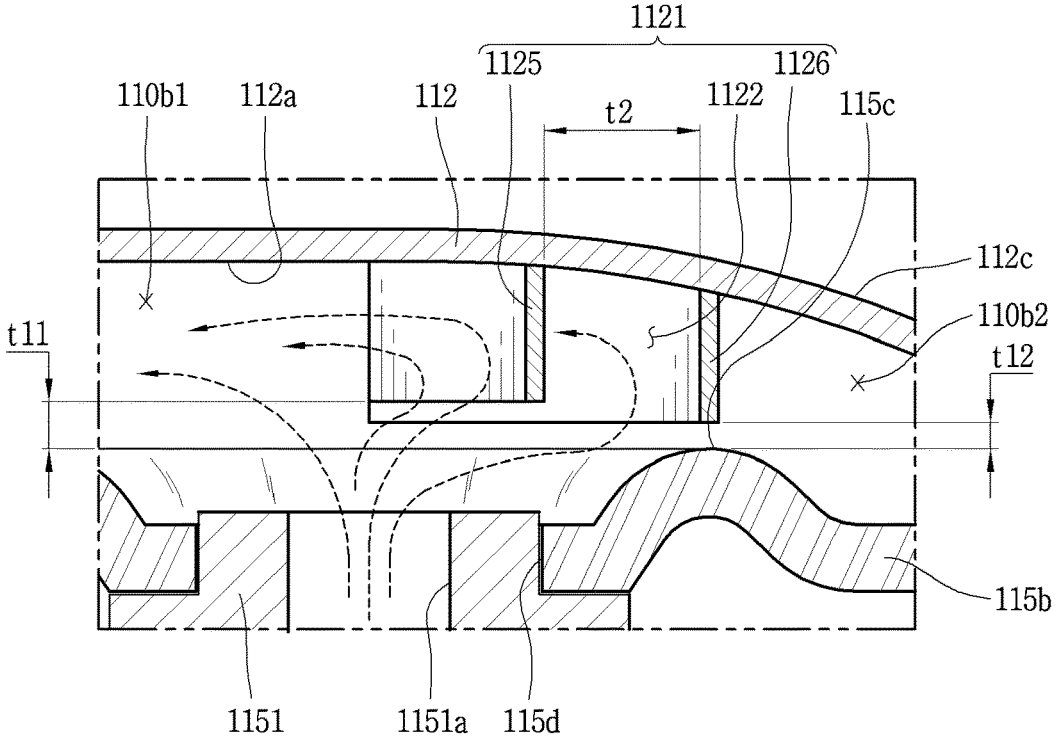
FIGS. 10A to 10C are sectional views taken along the line "V-V" of FIG. 9.

For example, as illustrated in FIG. 10A, the first discharge guide 1125 may be located more inward than the second protrusion 115*c* and the second discharge guide 1126 may be located on the same axis as the second protrusion 115*c*. In this case, even if the first discharge guide 1125 and the second discharge guide 1126 are formed at the same height, the first axial gap t11 at the first discharge guide 1125 may be greater than the second axial gap t12 at the second discharge guide 1126 by a height, by which the second protrusion 115*c* of the high and low pressure separation plate 115 protrudes higher than a peripheral height of the through hole 115*d*. Accordingly, as the first axial gap t11 is greater than the second axial gap t12, flow resistance is reduced around the through hole of the high and low pressure separation plate 115 [it is precisely the high and low communication hole 1151*a* of the sealing plate 1151 but it will be described as the through hole of the high and low pressure separation plate for the sake of explanation]. Through this, refrigerant can be smoothly discharged from the compression part to the high-pressure part 110*b*.

In addition, the second axial gap t12 is smaller than the first axial gap t11, and thereby refrigerant discharged to the high-pressure part 110*b* is blocked from flowing into the space toward the first protrusion 115*b*, thereby quickly moving to the refrigerant discharge pipe 118. This can result in effectively suppressing the high and low pressure separation plate 115 from being overheated by high-temperature discharge refrigerant.

Figure 10B:
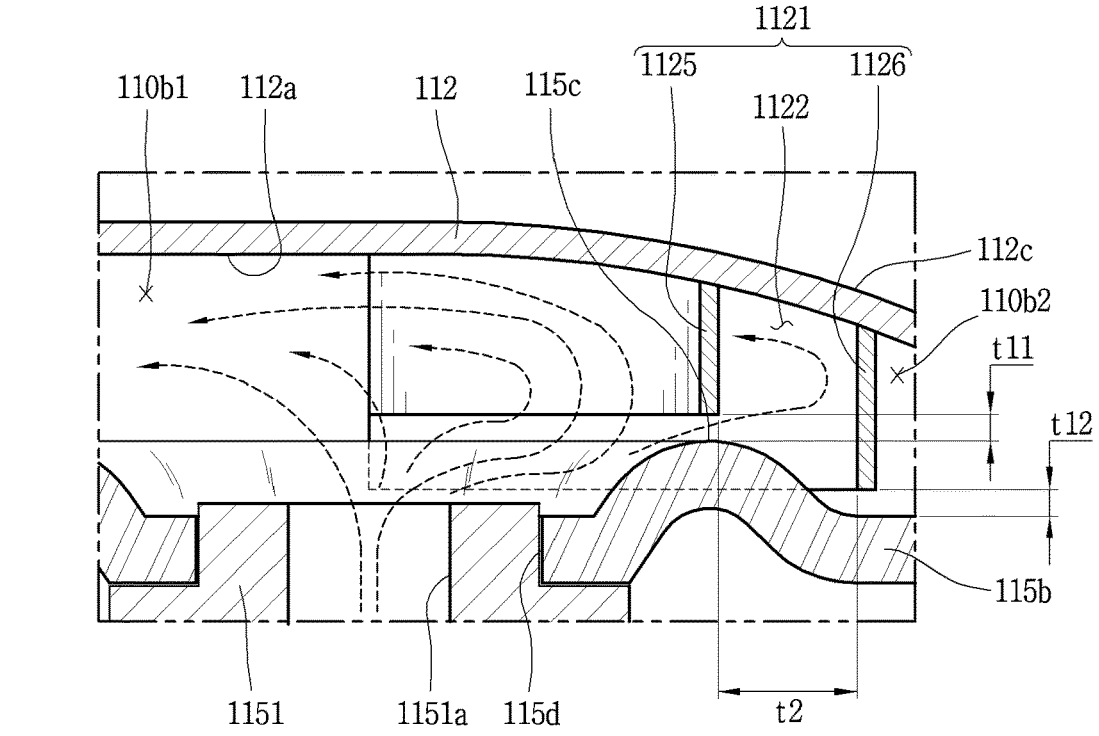

On the other hand, when the plurality of discharge guides 1125 and 1126 are provided as illustrated in FIG. 10B, the axial gaps t11 and t12 between the respective discharge guides 1125 and 1126 and the high and low pressure separation plate 115 may be the same.

For example, the first discharge guide 1125 may be located at a position facing the upper end of the second protrusion 115*c*, and the second discharge guide 1126 may be located at the outer side of the second protrusion 115*c*. The first axial gap t11 between the first discharge guide 1125 and the second protrusion 115*c* may be almost the same as the second axial gap t12 between the second discharge guide 1126 and the outer side of the second protrusion 115*c* (for example, a boundary position between the first protrusion and the second protrusion or a position including a part of the first protrusion). Accordingly, the first discharge guide 1125 is located farther from the through hole 115*d* of the high and low pressure separation plate 115 compared to the implementation of FIG. 10A described above.

Then, even if the first axial gap t11 becomes narrower than that in the implementation of FIG. 10A described above, the first discharge guide 1125 is located far from the discharge passage, that is, the through hole 115*d* of the high and low pressure separation plate 115. Therefore, flow resistance does not occur greatly when refrigerant is discharged, and accordingly, the refrigerant can be smoothly discharged from the compression part to the high-pressure part 110*b*. In addition, since the refrigerant which has flowed out of the first discharge guide 1125 is guided to the refrigerant discharge pipe 118 by the second discharge guide 1126, the overheat of the high-low pressure separation plate 115 due to discharge refrigerant of high temperature can be effectively suppressed.

Although not illustrated, the first discharge guide 1125 may be located more inward than the second protrusion 115*c* and the second discharge guide 1126 may be located at a position facing the upper end of the second protrusion 115*c*. Even in this case, the first axial gap t11 at the first discharge guide 1125 and the second axial gap t12 at the second discharge guide 1126 may be formed to be substantially the same. In this case, discharge refrigerant can move toward the refrigerant discharge pipe 118 more rapidly.

Figure 10C:
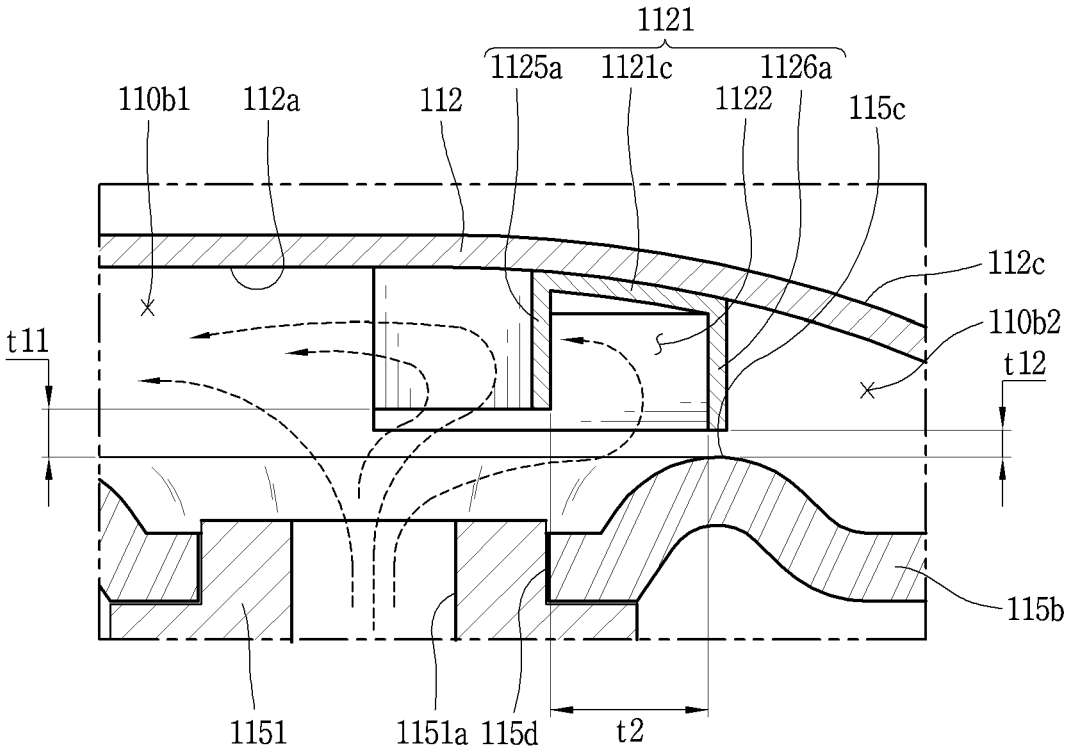

In addition, when the plurality of discharge guides are provided as in this implementation, the plurality of discharge guides may be formed independently of each other, but may be formed as a single unit in some cases. The former case may be advantageous in that a large flow area of refrigerant can be secured, and the latter case may be advantageous in that the plurality of discharge guides can be easily assembled. FIG. 10C illustrates the latter case, that is, an example in which the plurality of discharge guides are formed as a unit.

Referring to FIG. 10C, the blocking portions 1125*a* and 1126*a* of the first discharge guide 1125 and the second discharge guide 1126 may extend integrally from a fixed plate portion 1121*c*. For example, the fixed plate portion 1121*c* may be formed in an annular or arcuate shape, and the blocking portion 1125*a* of the first discharge guide 1125 and the blocking portion 1126*a* of the second discharge guide 1126 may extend from one side surface of the fixed plate portion 1121*c* toward the high and low pressure separation plate 115.

The blocking portion 1125*a* of the first discharge guide 1125 and the blocking portion 1126*a* of the second discharge guide 1126 may be formed by bending both ends of the single fixed plate portion 1121*c* in the same direction, or may be welded on the one side surface of the fixed plate portion 1121*c*.

As described above, the blocking portion 1125*a* of the first discharge guide 1125 and the blocking portion 1126*a* of the second discharge guide 1126 can extend from the single fixed plate portion 1121*c*, and another side surface of the fixed plate portion 1121*c* may be in close contact with the axial inner circumferential surface (lower surface) 112*a* of the upper cap 112. Accordingly, the discharge guide can be provided in plurality, i.e., 1125 and 1126, and the plurality of discharge guides can be easily assembled. Although not illustrated, this will be equally applied even to a case where three or more discharge guides 1121 are provided or the discharge guide 1121 is formed obliquely.

Meanwhile, three or more discharge guides may be provided.

In other words, the through hole 115*d* of the high and low pressure separation plate 115 may be surrounded by three or more layers. This can suppress leakage of discharge refrigerant to the second space portion 110*b*2 more effectively and simultaneously increase a surface area of the upper cap 112, thereby enabling more rapid heat dissipation of the discharge refrigerant.

Figure 11:
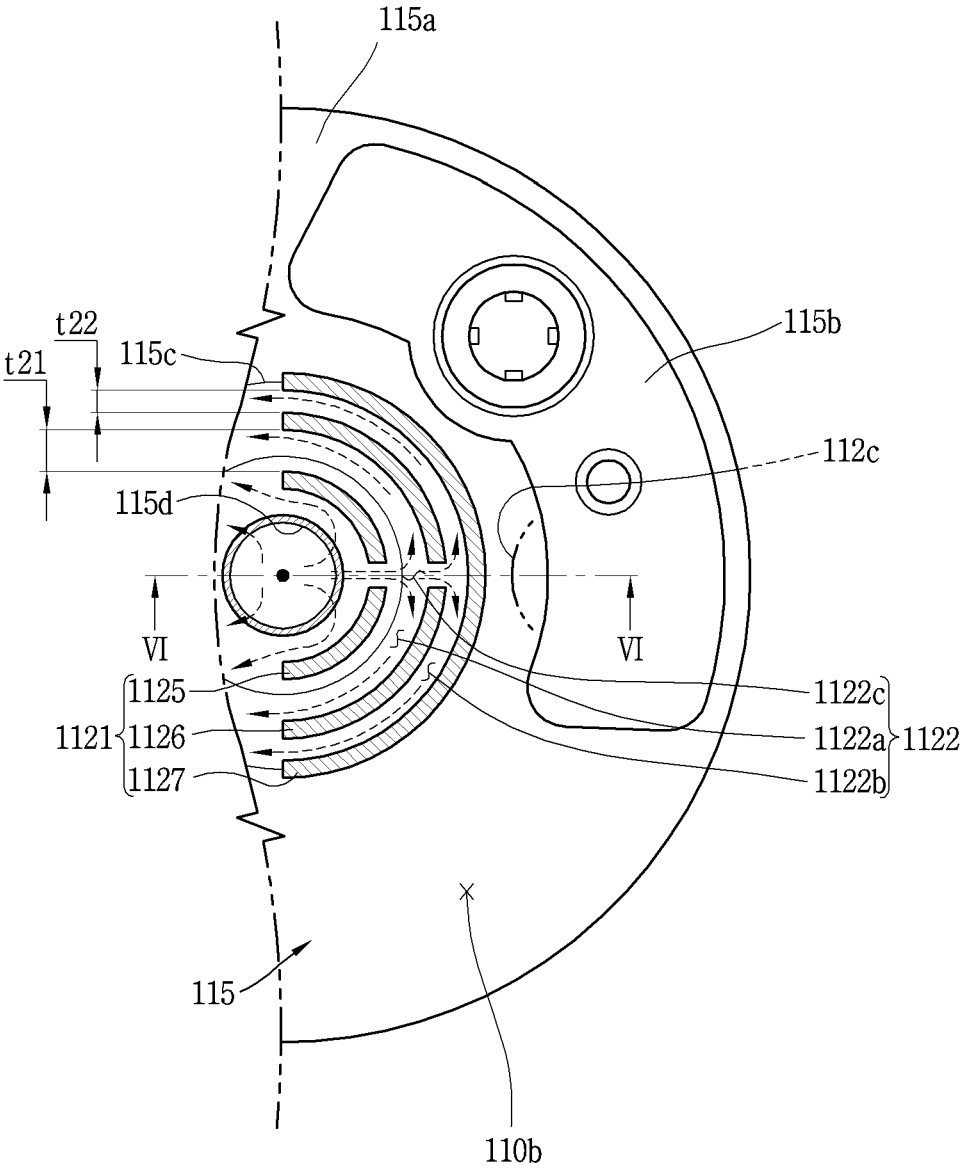
FIG. 11 is an enlarged schematic view illustrating still another implementation of a discharge guide in FIG. 4.
Figure 12:
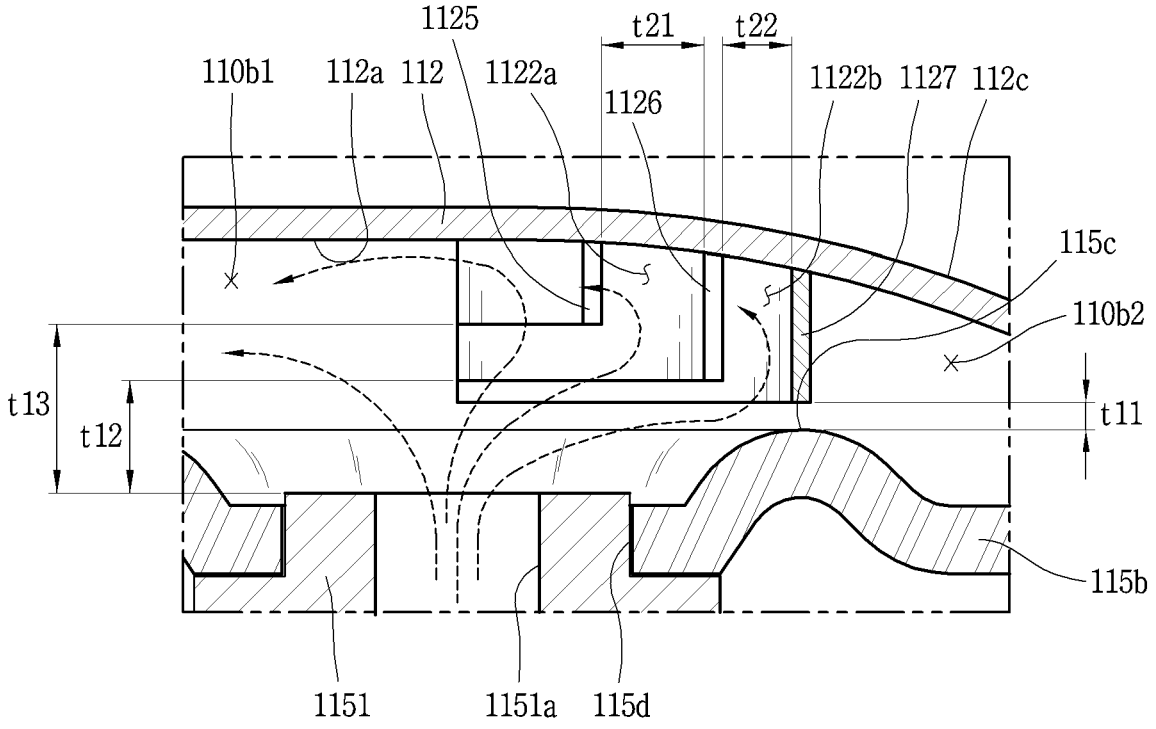
FIG. 12 is sectional view taken along the line "VI-VI" of FIG. 11.

FIG. 11 is an enlarged schematic view illustrating still another implementation of a discharge guide in FIG. 4, and FIG. 12 is sectional view taken along the line "VI-VI" of FIG. 11.

As illustrated in these drawings, when there are three or more discharge guides 1121, the plurality of discharge guides 1125, 1126, and 1127 may be disposed at equal distances or at different distances along the radial direction. FIGS. 11 and 12 illustrate an example in which the plurality of discharge guides are spaced apart from one another by different distances in the radial direction.

Specifically, a first circumferential passage 1122*a* may be defined between the first discharge guide 1125 and the second discharge guide 1126, and a second circumferential passage 1122*b* may be defined between the second discharge guide 1126 and the third discharge guide 1127. In this case, a first radial gap t21, which is a radial gap of the first circumferential passage 1122*a*, and a second radial gap t22, which is a radial gap of the second circumferential passage 1122*b*, may be equal to each other or different from each other.

For example, when the first radial gap t21 and the second radial gap t22 are the same, the discharge guides 1125, 1126, and 1127 can be easily manufactured and refrigerant can be evenly distributed in both of the circumferential passages 1122*a* and 1122*b*. This can suppress a bottleneck phenomenon due to concentration of the refrigerant in the circumferential passages 1122*a* and 1122*b* and simultaneously allow a uniform contact between each discharge guide 1125, 1126, and 1127 and the refrigerant, such that heat dissipation toward the upper cap 112 can be made smoothly.

On the other hand, as illustrated in FIGS. 11 and 12, when the first radial gap t21 and the second radial gap t22 are different from each other, the first radial gap t21 of the first circumferential passage 1122*a* adjacent from the through hole 115*d* may be greater than the second radial gap t22 of the second circumferential passage 1122*b* far apart from the through hole 115*d*. Accordingly, flow resistance around the through hole 115*d* of the high and low pressure separation plate 115 constituting the discharge passage can be reduced, so that the refrigerant can be smoothly discharged from the compression part to the high-pressure part 110*b*. In addition, discharge refrigerant can rapidly move toward the refrigerant discharge pipe 118 through the wide first circumferential passage 1122*a*, which may result in effectively suppressing the high and low pressure separation plate 115 from being overheated by discharge refrigerant of high temperature.

In addition, when there are three or more discharge guides 1125, 1126, and 1127 as in this implementation, a radial passage 1122*c* through which the first circumferential passage 1122*a* and the second circumferential passage 1122*b* communicate with each other may further be formed.

The radial passage 1122*c* may be formed radially through the first discharge guide 1125 and the second discharge guide 1126. Accordingly, the first discharge guide 1125 and the second discharge guide 1126 can be adjacent to the through hole 115*d* of the high and low pressure separation plate 115 and also flow resistance of discharge refrigerant can be minimized, so that refrigerant of the compression part can be discharged smoothly to the high-pressure part 110*b*. In addition, as the plurality of discharge guides 1121 are disposed, a surface area of the upper cap 112 can increase, so that heat can be rapidly dissipated from discharge refrigerant.

In this case, it may be preferable that the third discharge guide 1127 located at an outermost portion is formed in a seamless arcuate shape, that is, a single arcuate shape without a radial passage. Accordingly, the through hole 115*d* of the high and low pressure separation plate 115 and the first protrusion 115*b* can be blocked from each other by the third discharge guide 1127, to prevent discharge refrigerant from leaking out of the discharge guide 1121.

Although not illustrated, the radial passage 1122*c* may be disposed even when there are two discharge guides. In this case, the radial passage 1122*c* may be formed through the first discharge guide 1125 located at an inner side, but the second discharge guide 1126 located at an outer side may be formed in a single arcuate shape without the radial passage.

Hereinafter, a description will be given of still another implementation of the discharge guide.

That is, the discharge guide is formed in the arcuate shape in the previous implementation but may also be formed in a linear shape in some cases.

Figure 13:
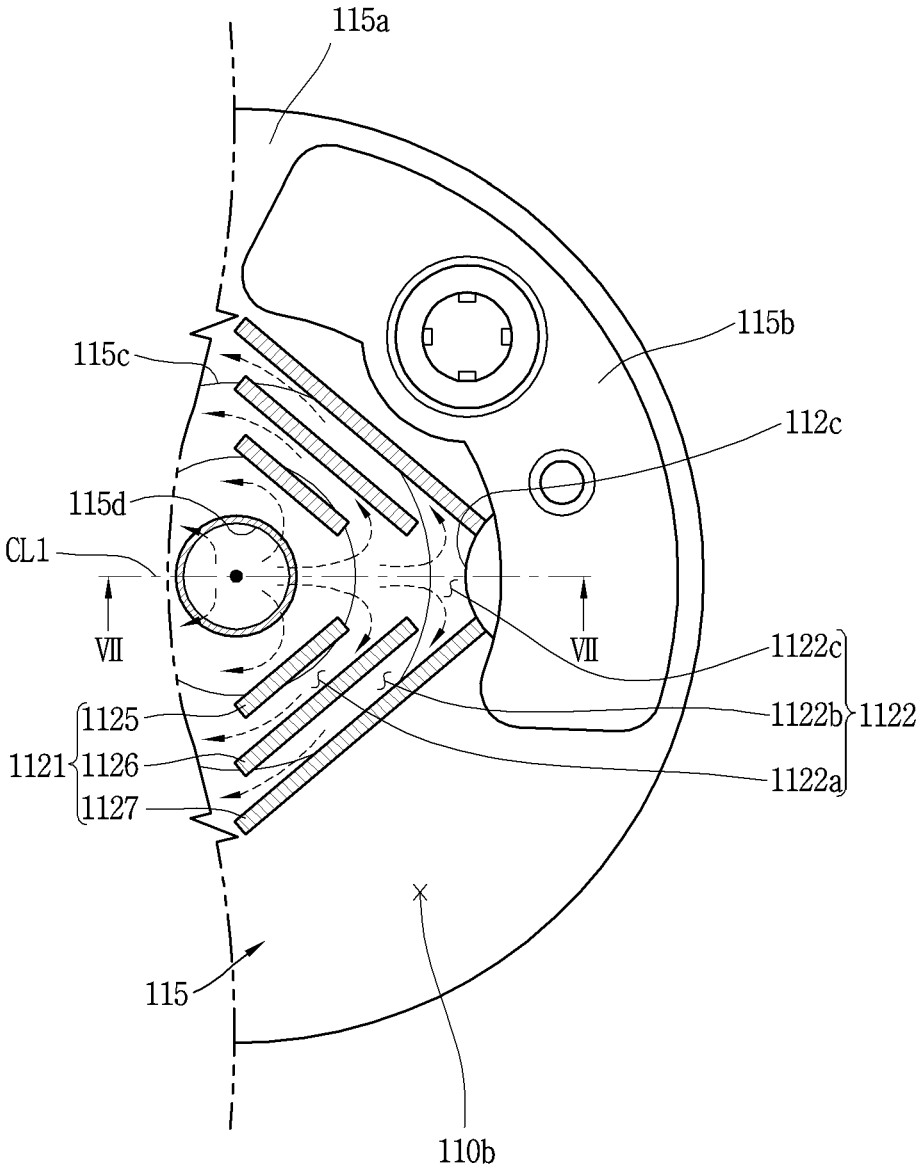
FIG. 13 is an enlarged schematic view illustrating still another implementation of a discharge guide in FIG. 4.
Figure 14:
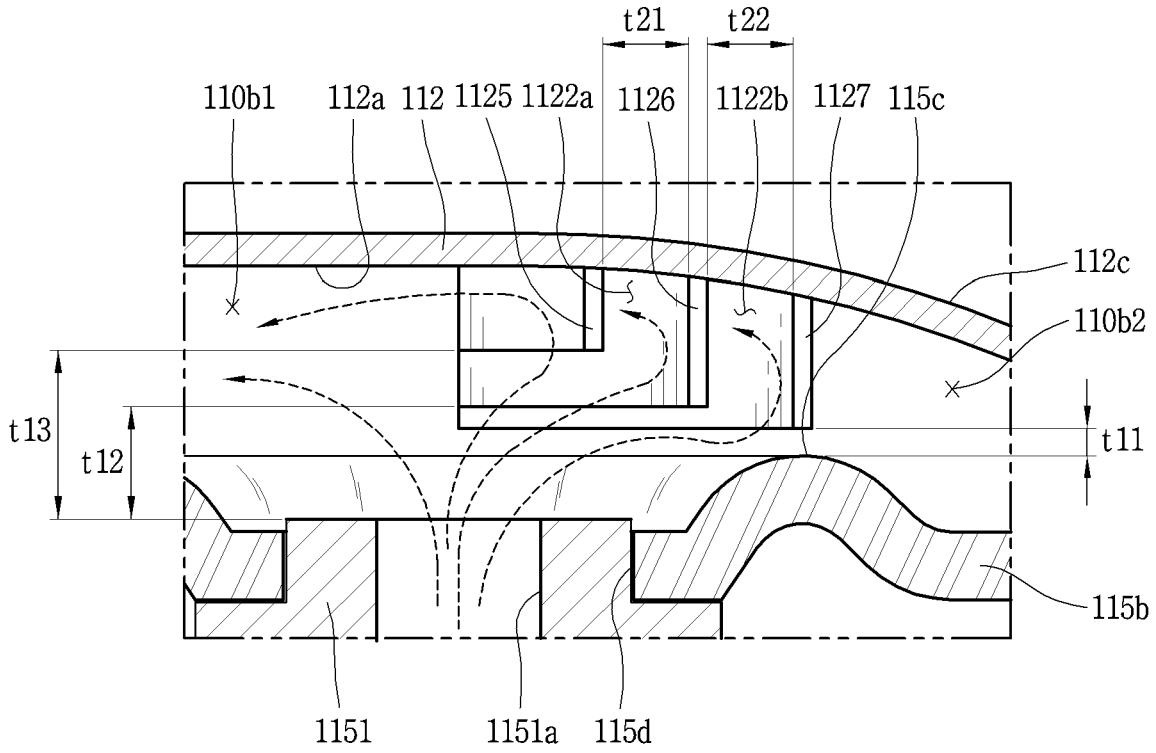
FIG. 14 is a sectional view taken along the line "VII-VII" of FIG. 13.

FIG. 13 is an enlarged schematic view illustrating still another implementation of a discharge guide in FIG. 4, and FIG. 14 is a sectional view taken along the line "VII-VII" of FIG. 13.

Referring to FIGS. 13 and 14, the basic configurations of the upper cap 112 and the high and low pressure separation plate 115 according to this implementation and the operating effects thereof are the same as those in the previous implementation. In addition, since the position and direction that the discharge guide 1121 is disposed are almost similar to those of the previous implementation, a description thereof will be replaced with the description of the previous implementation.

However, the discharge guides 1121 according to this implementation may be respectively disposed on both sides with respect to a first center line CL1. For example, the discharge guides 1121 respectively disposed on both sides with respect to the first center line CL1 may be connected to each other, or may be spaced apart from each other by a predetermined distance.

In this case, the discharge guide 1121 may be provided in a single number as in the previous implementations, or may be provided in plurality along the radial direction. Hereinafter, an example in which the discharge guide 1121 is formed linearly and provided in plurality in the radial direction will be mainly described.

Referring to FIG. 13, the discharge guides 1121 according to this implementation may be formed in a linear shape, to be obliquely inclined by a preset angle on both sides based on the first center line CL1. Both of the discharge guides 1121 may be symmetrical to each other with respect to the first center line CL1.

In other words, the discharge guide 1121 is disposed in a herringbone pattern extending on both sides with respect to the first center line CL1. Here, the discharge guides 1121 disposed on the both sides may be close to each other with a narrow gap at a position far apart from the refrigerant discharge pipe 118 and may be spaced apart from each other by a wide gap at another position close to the refrigerant discharge pipe 118. Accordingly, refrigerant discharged from the compression part to the high-pressure part 110*b* through the through hole 115*d* can rapidly move to the periphery of the refrigerant discharge pipe 118 along the discharge guide 1121 so as to flow out of the casing 110. This can suppress the high and low pressure separation plate 115 from being overheated due to the refrigerant.

In this case, an inner end of the discharge guide 1121 according to this implementation may be located more inward than the second protrusion 115*c* while an outer end thereof may be located more outward than the second protrusion 115*c*. Accordingly, the discharge guide 1121 can extend close to the radial inner circumferential surface (side surface) of the upper cap 112, so as to minimize that refrigerant discharged from the compression part to the high-pressure part 110*b* flows toward the first protrusion 115*b* along the discharge guide 1121. With the configuration, discharge refrigerant can be blocked from flowing to the periphery of the first protrusion 115*b*, which does not define a substantial muffler space, namely, to the second space portion 110*b*2, thereby obtaining a pressure pulsation reduction effect while suppressing the high and low pressure separation plate 115 from being overheated.

In addition, as the discharge guide 1121 has a shorter length due to being formed obliquely, refrigerant discharged to the high-pressure part 110*b* more rapidly moves to the radial inner circumferential surface (side surface) of the upper cap 112. Accordingly, discharge refrigerant can rapidly move toward the refrigerant discharge pipe 118 to flow out of the compressor, so that the contact between the discharge refrigerant and the high and low pressure separation plate 115 can be suppressed.

On the other hand, when the discharge guide 1121 is formed oblique as in this implementation, the inner end of the discharge guide 1121 is located adjacent to the through hole 115*d* of the high and low pressure separation plate 115. Accordingly, when refrigerant of the compression part is discharged to the high-pressure part 110*b*, flow resistance may occur.

Accordingly, the inner ends of the discharge guides 1121 according to this implementation are spaced apart from each other, to define the radial passage 1122*c* that penetrates in the radial direction between the discharge guides 1121 along the first center line CL1. The radial passage 1122*c* may communicate with the first circumferential passage 1122*a* and the second circumferential passage 1122*b* as in the previous implementation. Accordingly, the inner ends of the discharge guides 1121 can be adjacent to the through hole 115*d* of the high and low pressure separation plate 115 while flow resistance can be minimized, so that refrigerant of the compression part can be discharged smoothly to the high-pressure part 110*b*.

Although not illustrated, even in this implementation, the discharge guides 1121 located on the both sides based on the first center line CL1 at the outermost side may be connected to each other or formed at the same height. Accordingly, discharge refrigerant can move toward the refrigerant discharge pipe 118 without flowing out of the discharge guide 1121.

Although not illustrated, the discharge guides 1121 may be formed in a curved shape on both sides based on the first center line CL1. Even in this case, since the basic shape and its operating effects are similar to those of the aforementioned oblique discharge guides 1121, a description thereof will be replaced with the description of the previous implementation. However, when the discharge guides 1121 are formed in the curved surface as in this implementation, refrigerant can move more smoothly along the discharge guide 1121 having the curved surface.

Hereinafter, a description will be given of still another implementation of the discharge guide.

That is, in the previous implementation, the discharge guides are symmetrical with respect to the first center line, but in some cases, may be asymmetrical with respect to the first center line.

Figure 15:
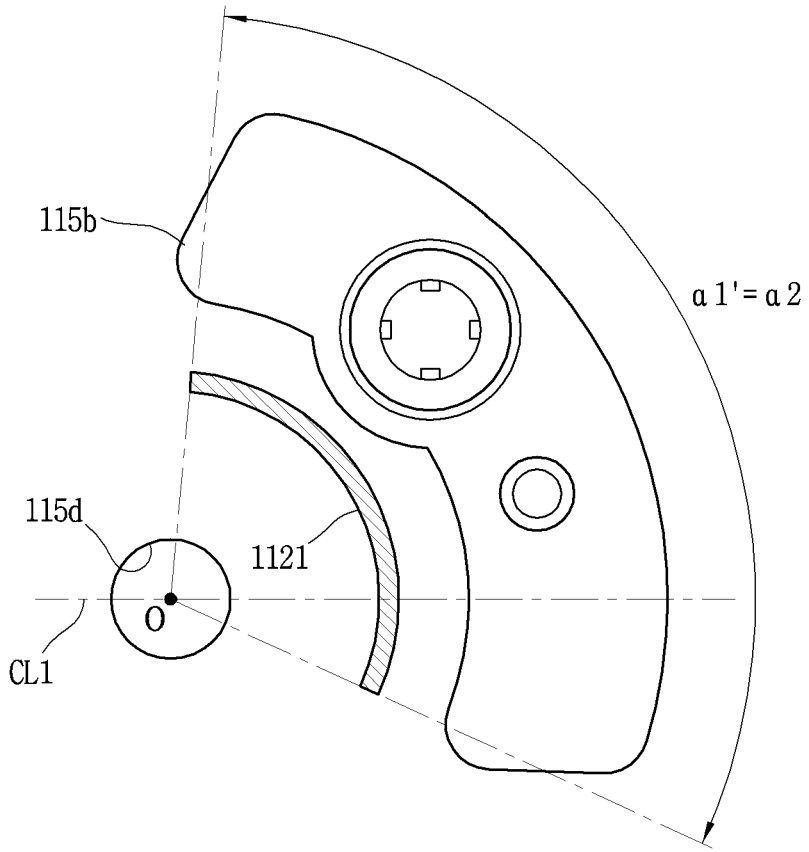
FIG. 15 is a horizontal sectional view illustrating still another implementation of a discharge guide in FIG. 3.

FIG. 15 is a horizontal sectional view illustrating still another implementation of a discharge guide in FIG. 3.

Referring to FIG. 15, the basic configurations of the upper cap 112 and the high and low pressure separation plate 115 according to this implementation and the operating effects thereof are the same as those in the previous implementation. However, the discharge guide 1121 may be asymmetrical with respect to the first center line CL1.

For example, the discharge guide 1121 may be formed based on the same arcuate center as the first protrusion 115*b*. In other words, the discharge guide 1121 may also be eccentric with respect to the first center line CL1 by an angle at which the first protrusion 115*b* is eccentric with respect to the first center line CL1.

Even in this case, a central angle $\alpha 1'$ of the discharge guide 1121 may be larger than a central angel $\alpha 2$ of the first protrusion 115*b*, but the central angel $\alpha 1'$ of the discharge guide 1121 may be equal to the central angle $\alpha 2$ of the first protrusion 115*b*. FIG. 15 illustrates an example in which the central angle $\alpha 1'$ of the discharge guide 1121 is equal to the central angle $\alpha 2$ of the first protrusion 115*b*.

As described above, when the discharge guide 1121 and the first protrusion 115b are eccentric by the same angle with respect to the first center line, the central angle $\alpha 1'$ of the discharge guide 1121 may be equal to the central angle $\alpha 2$ of the first protrusion 115*b* as described above. In this case, the central angle $\alpha 1'$ of the discharge guide 1121 can be shortened, and thus the first space portion 110*b*1 can be widely used. In other words, in this implementation, the first space portion 110*b*1 may extend to both ends of the first protrusion 115*b*, thereby increasing a volume of the substantial muffler space. This structure can suppress overheating of the high and low pressure separation plate 115, and also enhance the pressure pulsation reduction effect by sufficiently utilizing the high-pressure part 110*b*.

Hereinafter, a description will be given of still another implementation of the discharge guide.

That is, the discharge guide is formed in the upper cap in the previous implementations, but in some cases may be disposed in the high and low pressure separation plate.

Figure 16:
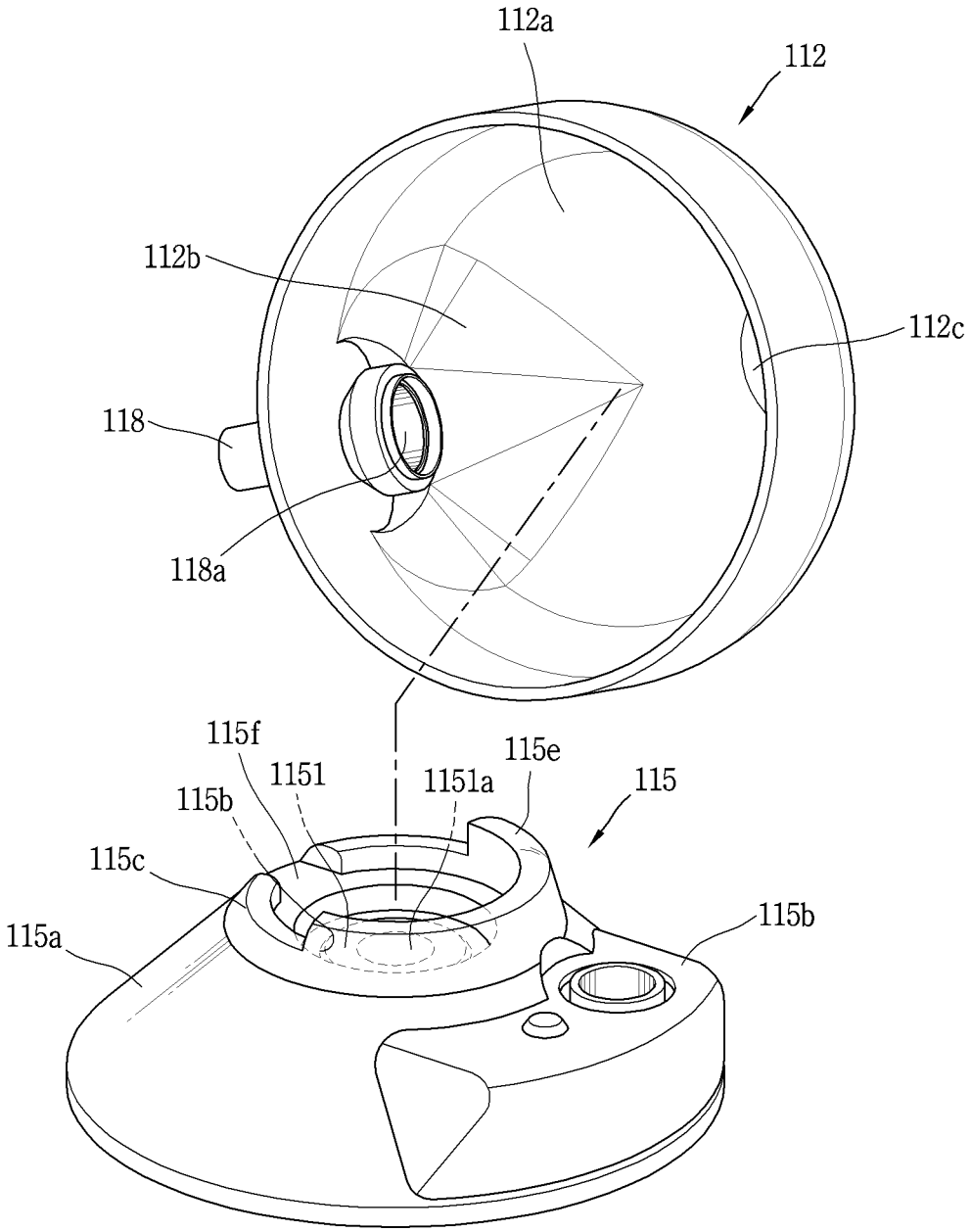
FIG. 16 is an exploded perspective view illustrating a high and low pressure separation plate and a lower cap in accordance with still another implementation of a discharge guide.
Figure 17:
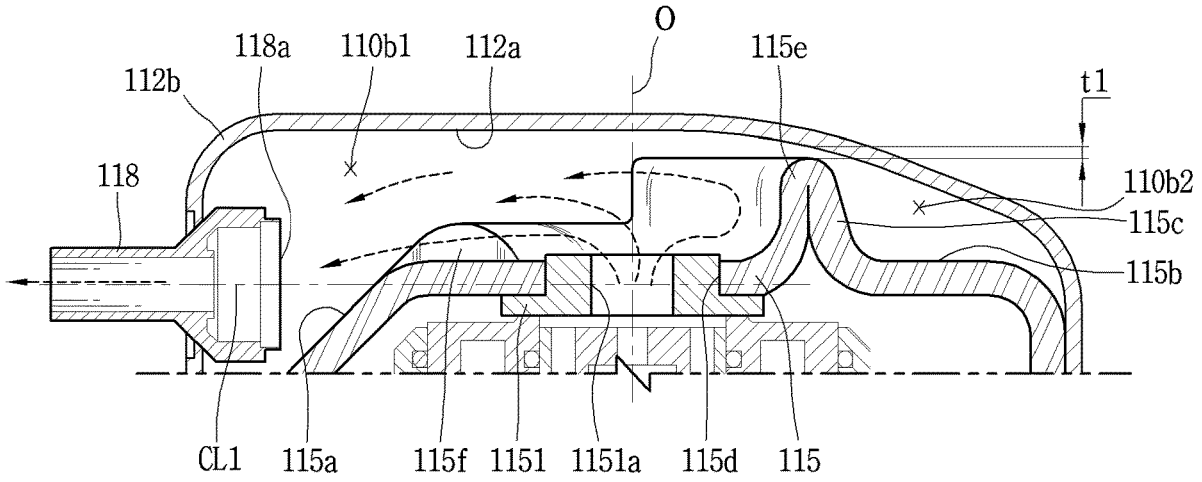
FIG. 17 is an assembled longitudinal sectional view of the high and low pressure separation plate and the lower cap in FIG. 16.

FIG. 16 is an exploded perspective view illustrating a high and low pressure separation plate and a lower cap in accordance with still another implementation of a discharge guide, and FIG. 17 is an assembled longitudinal sectional view of the high and low pressure separation plate and the lower cap in FIG. 16.

Referring to FIGS. 16 and 17, the basic configurations of the upper cap 112 and the high and low pressure separation plate 115 according to this implementation and the operating effects thereof are similar to those in the previous implementation. However, in this implementation, a discharge guide protrusion 115*e* defining the discharge guide may be formed on the upper surface of the high and low pressure separation plate 115, that is, on the surface facing the upper cap 112.

For example, the discharge guide protrusion 115*e* defining the discharge guide may be formed such that one axial end thereof is coupled to or extends from one side surface of the high and low pressure separation plate 115 and another axial end is open to be spaced apart from the lower surface 112*a* of the upper cap 112 by a preset axial height t1.

Specifically, the high and low pressure separation plate 115 may include a second protrusion 115*c* protruding in the axial direction toward the lower surface of the upper cap 112 along the periphery of the through hole 115*d*, an inclined surface portion 115*a* extending from the second protrusion 115*c* toward the compression part to be downwardly inclined, and a first protrusion 115*b* protruding from the middle of the inclined surface portion 115*a* in the circumferential direction and extending in the radial direction.

The discharge guide protrusion 115*e* defining the discharge guide may extend integrally from the second protrusion 115*c* along the second protrusion 115*c*. In other words, the discharge guide protrusion 115*e* defining the discharge guide may extend further in the axial direction from an upper end of the second protrusion 115*c* toward the lower surface 112*a* of the upper cap 112, but may have an arcuate shape which is closed toward the first protrusion 115*b* and open toward the refrigerant discharge pipe 118. Accordingly, refrigerant discharged to the high-pressure part 110*b* can move in the circumferential direction along the discharge guide protrusion 115*e*, which extends from the upper end of the second protrusion 115*c*, as well as the second protrusion 115*c*. Then, discharge refrigerant can quickly move to the first space portion 110*a*1, which is the periphery of the first protrusion 115*b*, without flowing to the second space portion 110*b*2, which is the periphery of the first protrusion 115*b*, in the high-pressure part 110*b*.

In this case, the second protrusion 115*c* of the high and low pressure separation plate 115 may be formed in an annular shape as in the previous implementations, but may be formed to be partially recessed in some cases. For example, the high and low pressure separation plate 115 may further include a discharge guide groove 115*f* that is recessed by a preset depth from the second protrusion 115*c*.

The discharge guide groove 115*f* may be formed at a position where it intersects with the first center line CL1 extending along a longitudinal direction of the refrigerant discharge pipe 118 through the axial center O of the rotating shaft 125. Accordingly, discharge refrigerant can move more rapidly toward the refrigerant discharge pipe 118. In addition, a surface area of the high and low pressure separation plate 115 can be reduced by the discharge guide groove 115*f*, so that the high and low pressure separation plate 115 can be suppressed from being heated by the discharge refrigerant.

When the discharge guide protrusion 115*e* defining the discharge guide is formed on the high and low pressure separation plate 115 as described above, the discharge guide protrusion 115*e* defining the discharge guide can be molded together when the high and low pressure separation plate 115. This can facilitate the manufacturing of the upper cap 112 as well as the discharge guide.

In addition, as the discharge guide protrusion 115*e* constituting the discharge guide extends from the upper end of the second protrusion 115*c*, the discharge guide protrusion 115*e* constituting the discharge guide can be easily formed on the high and low pressure separating plate 115 while an increase in surface area of the high and low pressure separation plate 115 due to the guide protrusion 115*e* can be minimized. This can suppress the high and low pressure separation plate 115 from being overheated by the discharge guide protrusion 115*e* constituting the discharge guide.

In addition, as the recessed discharge guide groove 115*f* is formed in the middle of the second protrusion 115*c* in the circumferential direction, discharge refrigerant discharged to the high-pressure part 110*b* can be smoothly guided toward the refrigerant discharge pipe 118 even without greatly increasing a height of the discharge guide protrusion 115*e* constituting the discharge guide. Through this, the high and low pressure separation plate 115 can be easily formed and at the same time can be more effectively suppressed from being overheated due to the discharge guide protrusion 115*e* constituting the discharge guide.

Although not illustrated, the discharge guide may also be formed on the lower surface of the upper cap as in the previous implementations, as well as the high and low pressure separation plate. In this case, the discharge guides formed on both sides may intersect with each other in the radial direction. This can suppress leakage of discharge refrigerant more effectively.

Hereinafter, a description will be given of another implementation of a high and low pressure separation plate.

That is, in the previous implementation, the high and low pressure separation plate is formed of the same single material as the casing or may be implemented as a single component, but in some cases, the high and low pressure separation plate may be formed of a different material from the casing or may be implemented as a plurality of components.

Figure 18:
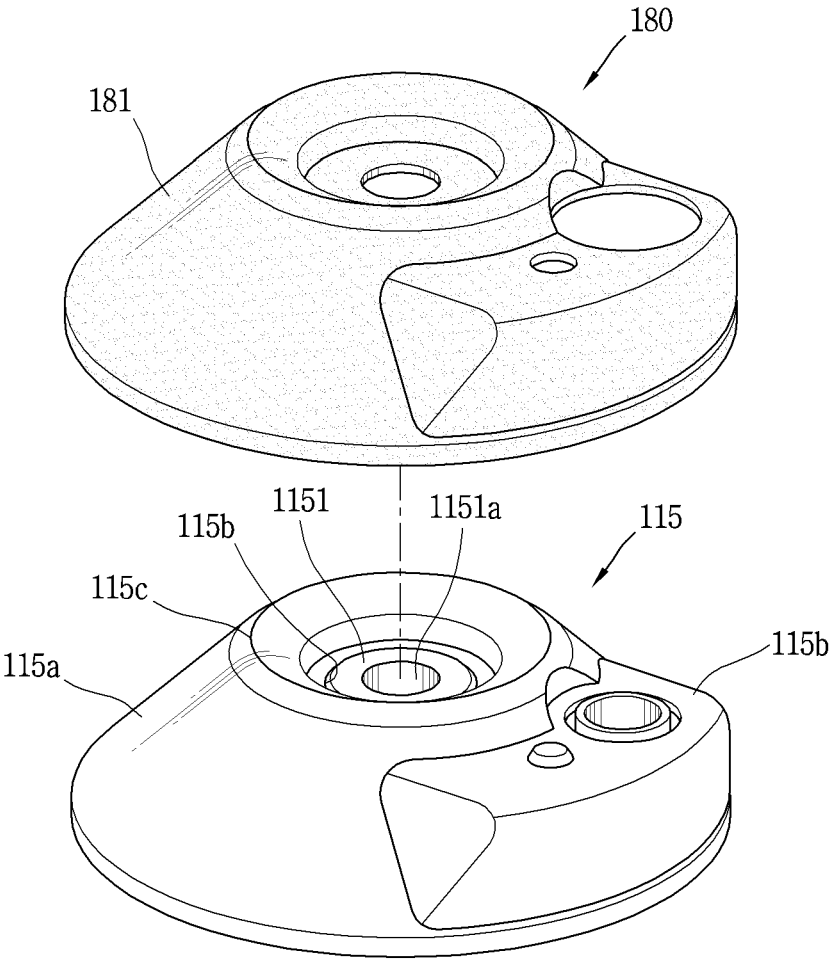
FIG. 18 is an exploded perspective view illustrating another implementation of a high and low pressure separation plate in FIG. 1.
Figure 19:
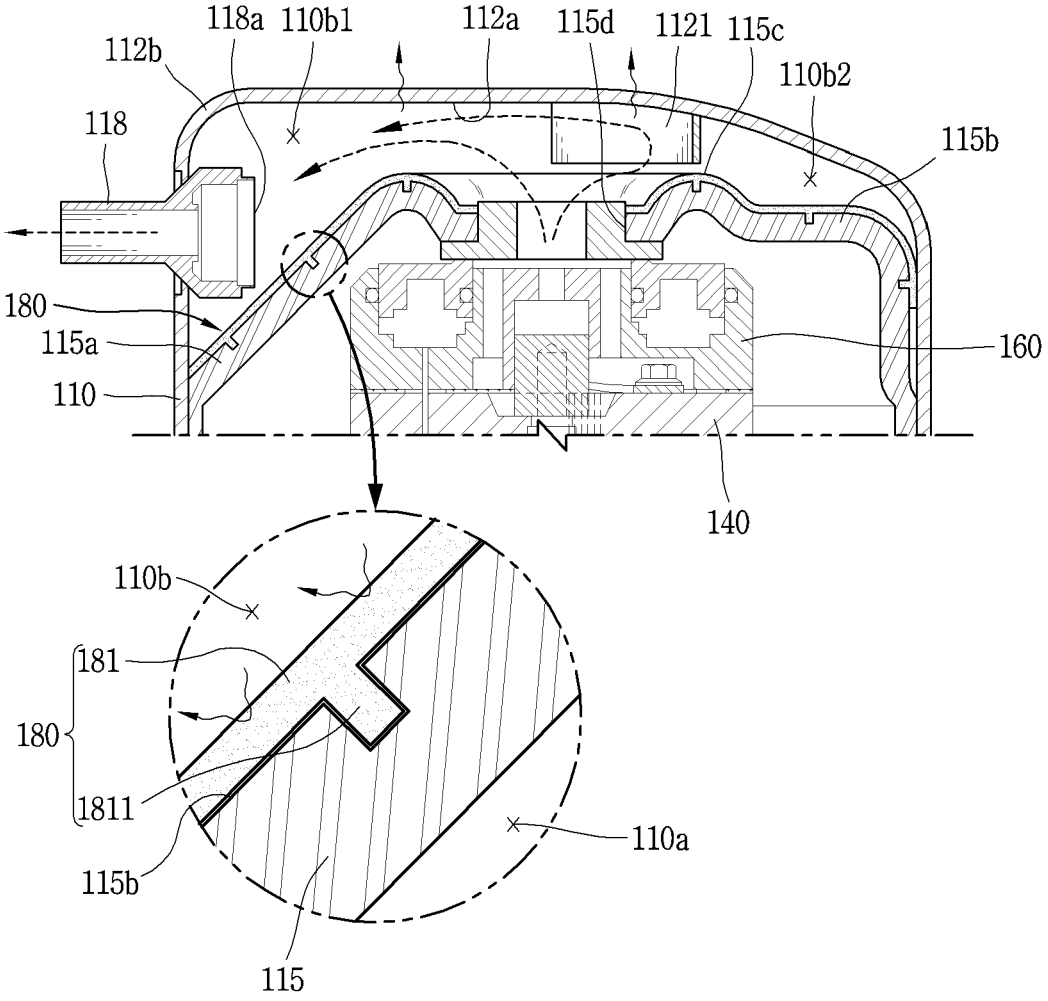
FIG. 19 is an assembled longitudinal sectional view of the high and low pressure separation plate of FIG. 18.
Figure 20:
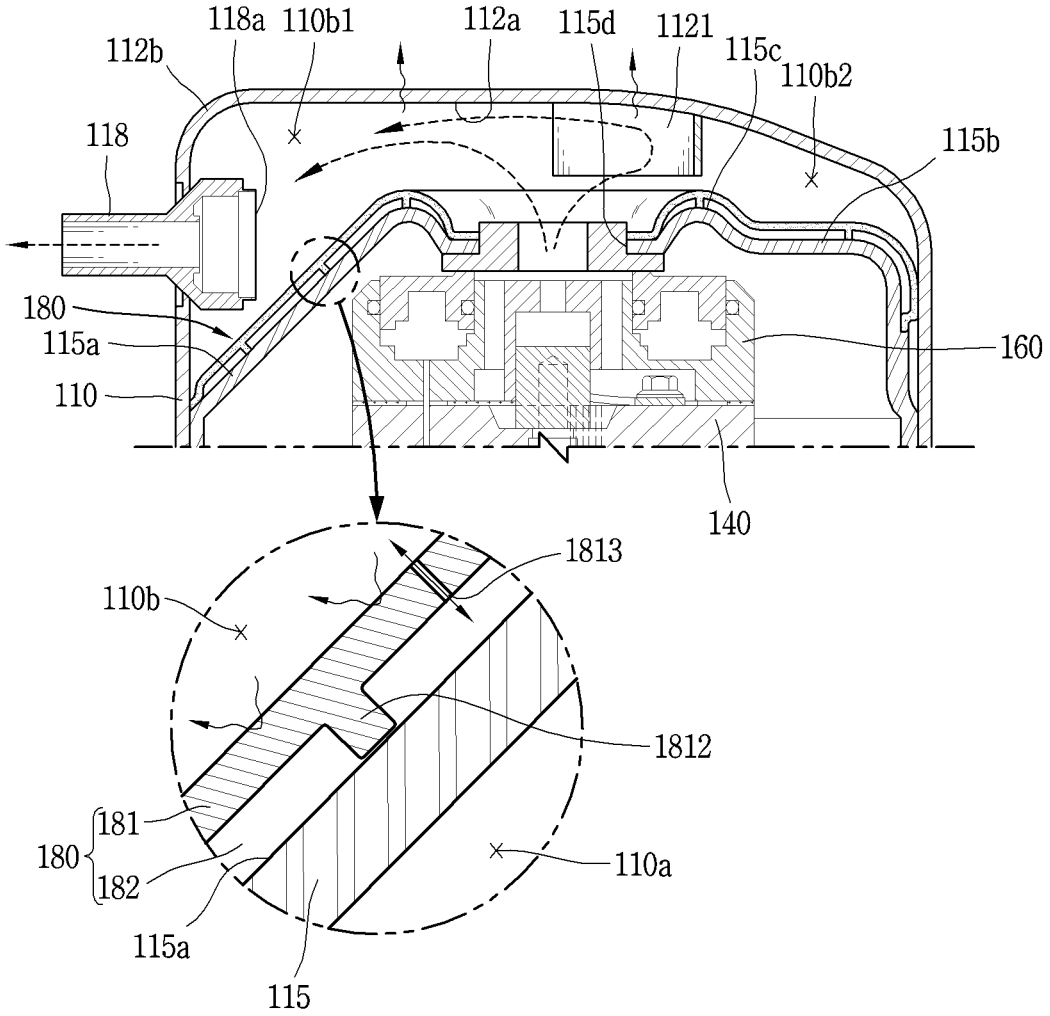
FIG. 20 is an assembled longitudinal sectional view illustrating still another implementation of the high and low pressure separation plate in FIG. 1.
Figure 21:
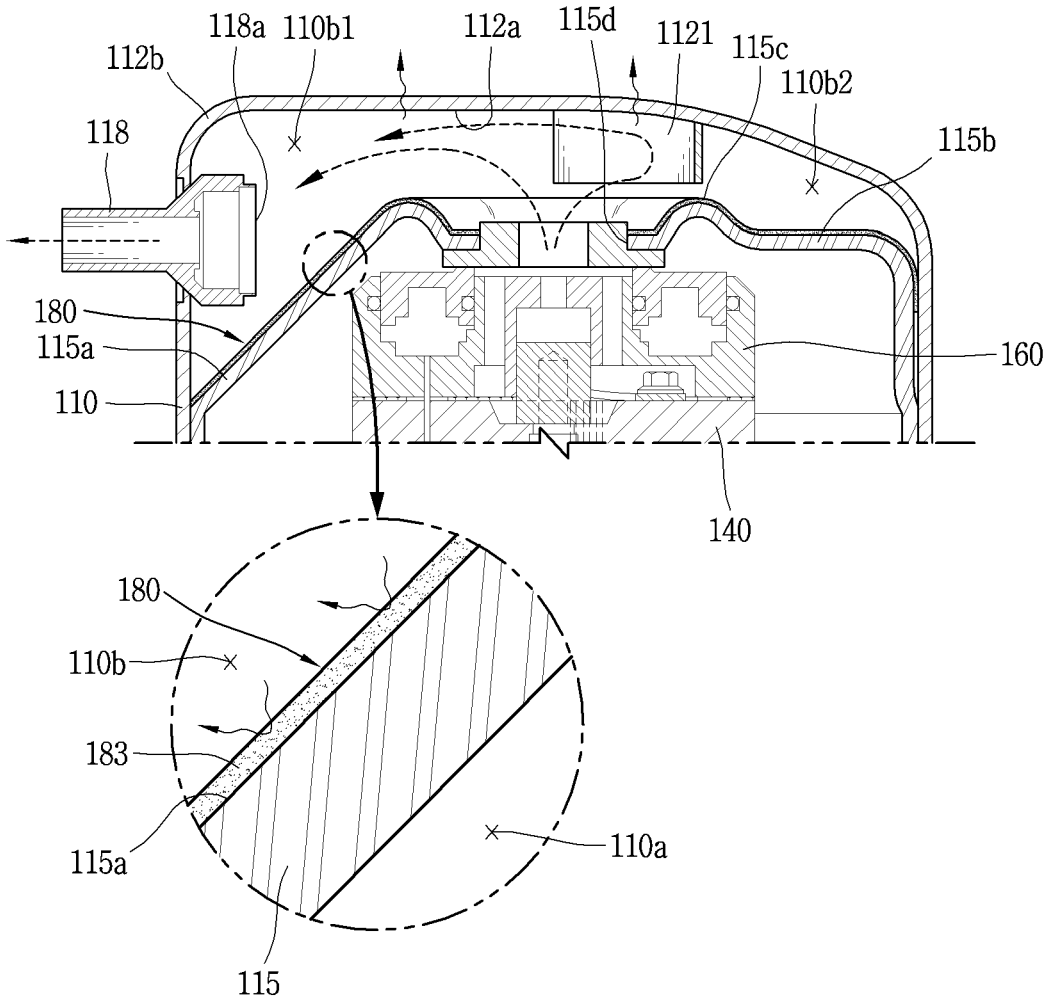
FIG. 21 is an assembled longitudinal sectional view illustrating still another implementation of a high and low pressure separation plate in FIG. 1.

FIG. 18 is an exploded perspective view illustrating another implementation of a high and low pressure separation plate in FIG. 1, FIG. 19 is an assembled longitudinal sectional view of the high and low pressure separation plate of FIG. 18, FIG. 20 is an assembled longitudinal sectional view illustrating still another implementation of the high and low pressure separation plate in FIG. 1, and FIG. 21 is an assembled longitudinal sectional view illustrating still another implementation of the high and low pressure separation plate in FIG. 1.

Referring to these drawings, the basic configurations of the upper cap 112 and the high and low pressure separation plate 115 according to this implementation and the operating effects thereof are the same as those in the previous implementation. For example, the discharge guide 1121 described above may be formed on the axial inner circumferential surface (lower surface) 112*a* of the upper cap 112. Since the discharge guide 1121 is formed in the same manner as in the previous implementations, the description of the discharge guide 1121 will be replaced with the description in the previous implementations.

However, the basic shape of the high and low pressure separation plate 115 according to this implementation is the same as that of the previous implementations, but an insulation unit 180 may be further provided. Accordingly, discharge refrigerant can rapidly move to the refrigerant discharge pipe 118 by the discharge guide 1121 so as to suppress overheating of the high and low pressure separation plate 115. At the same time, the high and low pressure separation plate 115 itself may also further include the insulation unit 180 to be prevented from being overheated. This can more effectively suppress the high and low pressure separation plate 115 from being overheated by discharge refrigerant, thereby further lowering a specific volume of suction refrigerant, and thus more enhancing efficiency of the compressor.

In addition, when an insulation cover is provided on the upper surface of the high and low pressure separation plate 115 as described above, the overheating of the high and low pressure separation plate 115 can be effectively suppressed even if the axial gap t1 of the discharge guide 1121 is longer than that in the previous implementation or the arcuate length is short. This can allow discharge refrigerant to stay in the high-pressure part 110*b* for a long time or turn widely, so that a substantial volume of the high-pressure part 110*b* can be enlarged compared to the previous implementation and pressure pulsation can be further reduced accordingly.

Referring to FIGS. 18 and 19, the insulation unit 180 according to the implementation may include an insulation cover 181 assembled to the high and low pressure separation plate 115. The insulation cover 181 may be installed on one side surface of the high and low pressure separation plate 115, that is, the upper surface facing the upper cap 112. Accordingly, the insulation cover 181 may be formed in the same shape as the upper surface of the high and low pressure separation plate 115 to be in close contact with the upper surface of the high and low pressure separation plate 115.

The insulation cover 181 may be made of an insulating material, for example, synthetic resin or non-ferrous metal. The insulation cover 181 may be separately manufactured and post-assembled to the high and low pressure separation plate 115, or may be formed in an insert-molding manner after the high and low pressure separation plate 115 is manufactured. Accordingly, the insulation cover 181 may be excluded from the rim of the high and low pressure separation plate 115, which is in contact with the casing 110, in consideration of welding heat generated when the casing 110 and the high and low pressure separation plate 115 are welded.

As the insulation cover 181 is post-assembled to the high and low pressure separation plate 115 or is formed by the insert-molding, a separation-preventing portion 1811 may be further disposed on a contact surface between the insulation cover 181 and the high and low pressure separation plate 115. The separation-preventing portion 1811 may be formed to be uneven, such as protrusions and grooves, or serrations or wedges, so as to prevent separation of the insulation cover 181 in the axial direction. This can stably maintain the insulation cover 181.

Referring to FIG. 20, in this implementation, the insulation unit 180 is configured as the insulation cover 181, and may be spaced apart from the upper surface of the high and low pressure separation plate 115 by a preset distance. Accordingly, an insulation space 182 may be defined between the insulation cover 181 and the high and low pressure separating plate 115.

In this case, the insulation cover 181 may be formed of an insulating material or a material to transfer heat. In addition, the insulation cover 181 may be formed of a metal material in consideration of pressure of the high-pressure part 110*b*. However, a support protrusion 1812 may be formed on the insulation cover 181 and/or the high and low pressure separation plate 115, to maintain a preset distance between the insulation cover 181 and the high and low pressure separation plate 115. The support protrusion 1812 may be configured as a plurality of columns or may be formed in at least one annular shape. FIG. 20 illustrates an example in which the support protrusion 1812 includes a plurality of columns protruding from the insulation cover 181 toward the high and low pressure separation plate 115.

In addition, the insulation cover 181 may be coupled in close contact with the high and low pressure separation plate 115 so that the insulation space 182 is sealed in a vacuum state. However, at least one fine refrigerant through hole 1813 may further be formed through the insulation cover 181, so that refrigerant of the high-pressure part 110*b* can be minutely introduced into the insulation space 182.

When the insulation space 182 is defined between the insulation cover 181 and the high and low pressure separation plate 115 as described above, it can give a wider range to select a material for the insulation cover 181. For example, the insulation cover 181 may be made of a heat-transferring material in addition to the insulating material, and even if the insulating material is applied, a material having low insulation properties may be applied or the insulation cover 181 may be formed thin in thickness. This can reduce a manufacturing cost for the insulation cover 181.

Referring to FIG. 21, the insulation unit 180 according to this implementation may include an insulation layer 183 that is formed by coating or depositing an insulating material, such as zirconium, having low thermal conductivity on the high and low pressure separation plate 115. The insulation layer 183 may be formed over an entire portion of the upper surface of the high and low pressure separation plate 115 except for the rim.

When the insulation layer 183 is coated on the high and low pressure separation plate 115 as described above, the manufacturing cost for the insulation unit 180 can be further reduced and an insulation effect can be increased. In particular, the insulation layer 183 may have a relatively low insulation effect compared to the insulation cover 181. However, when the discharge guide 1121 as in the previous implementation is formed on the upper cap 112, the insulation effect can be sufficiently obtained only with the insulation layer. This can effectively suppress the overheating of the high and low pressure separation plate 115 while reducing the manufacturing cost.

Although not illustrated, the insulation layer may also be applied to the lower surface as well as the upper surface of the high and low pressure separation plate 115. The operating effect thereof is the same as above.

Hereinafter, a description will be given of another implementation of a non-orbiting scroll.

That is, in the previous implementation, the gap between the high and low pressure separation plate and the refrigerant suction pipe is open, but in some cases, a suction guide may be further provided between the high and low pressure separation plate and the refrigerant suction pipe.

Figure 22:
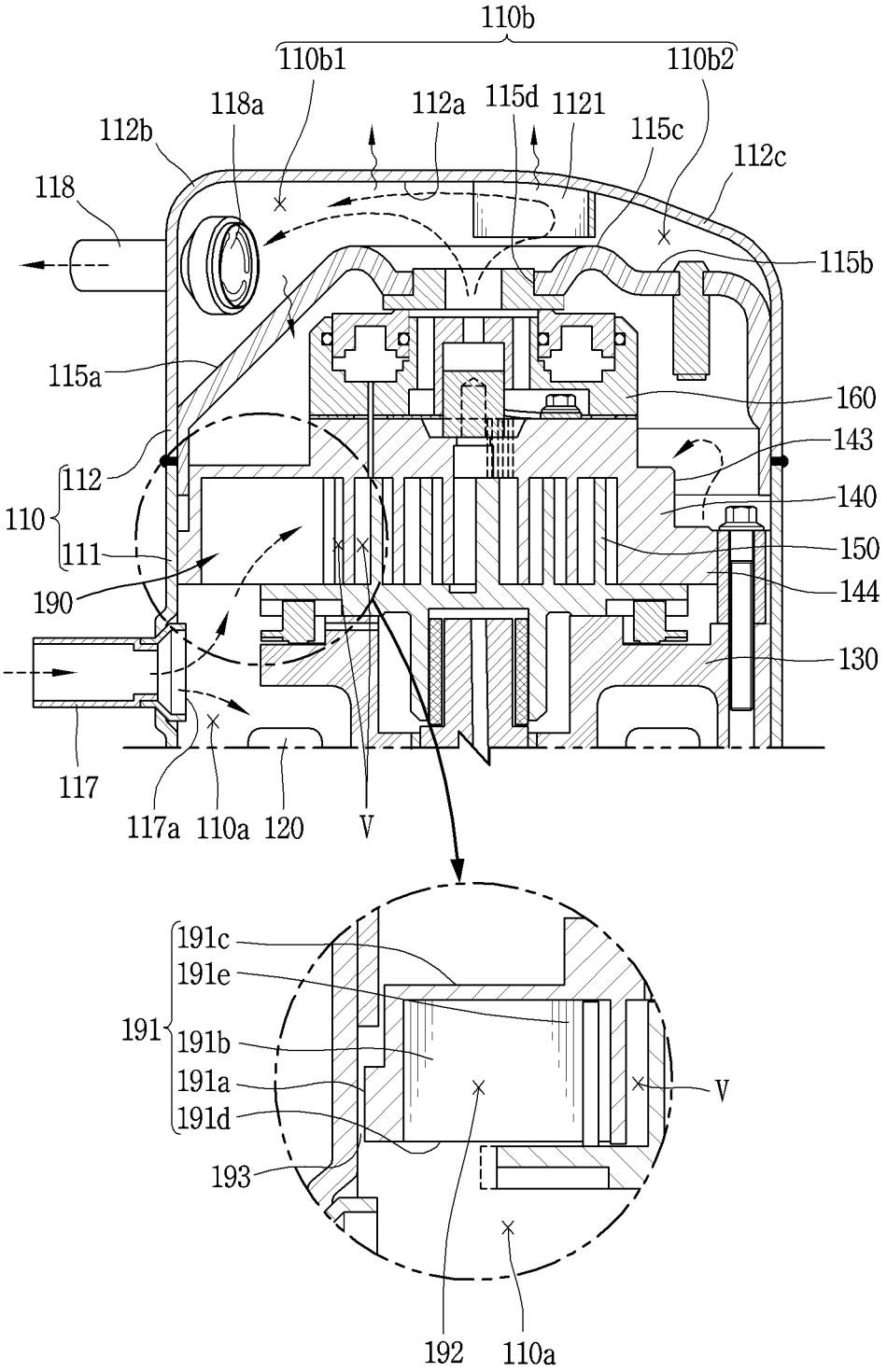
FIG. 22 is a longitudinal sectional view illustrating one implementation of a suction guide in FIG. 1.
Figure 23:
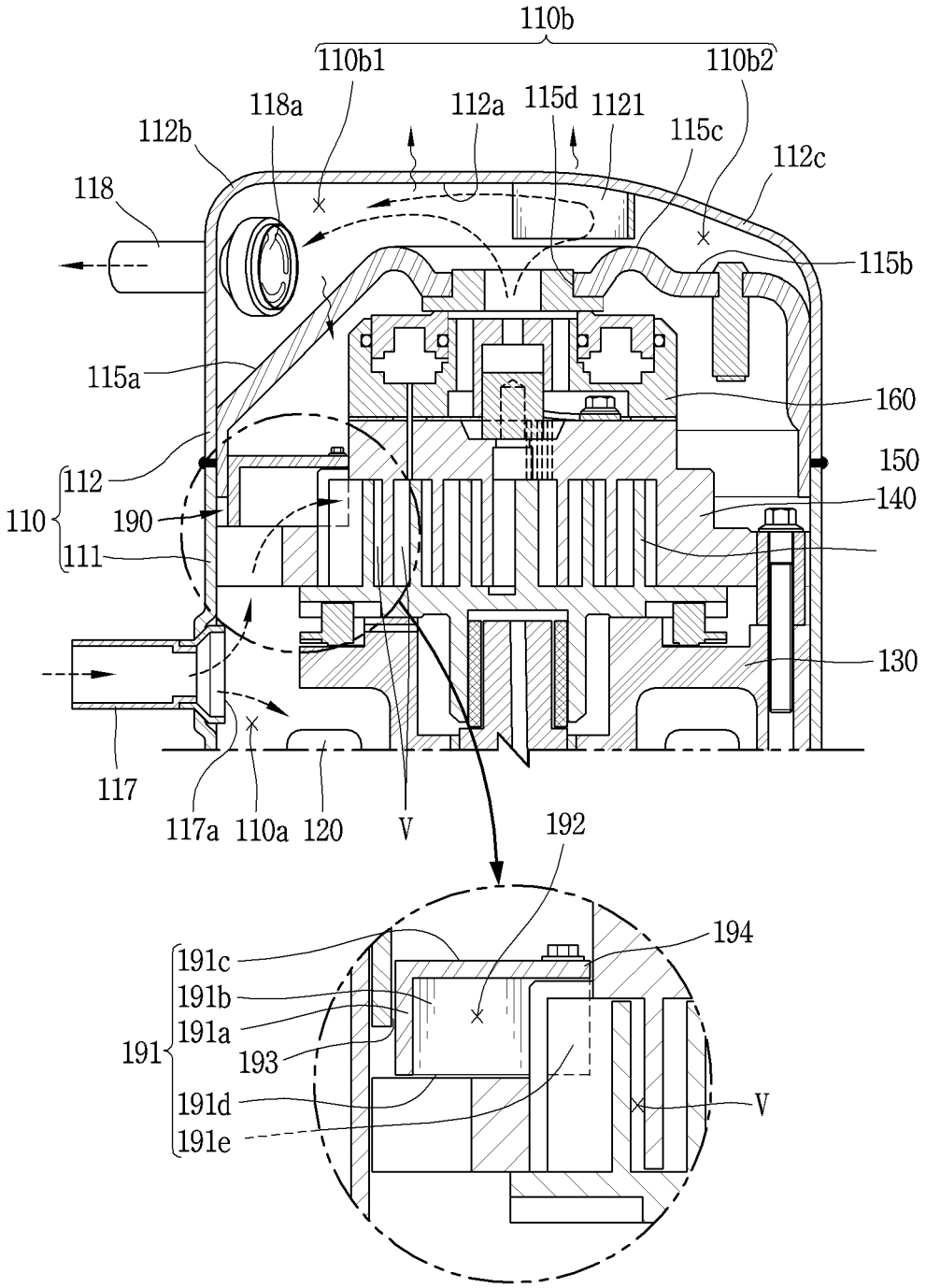
FIG. 23 is a longitudinal sectional view illustrating another implementation of a suction guide in FIG. 1.

FIG. 22 is a longitudinal sectional view illustrating one implementation of a suction guide in FIG. 1, and FIG. 23 is a longitudinal sectional view illustrating another implementation of a suction guide in FIG. 1.

Referring back to FIGS. 1 and 3, the basic shapes of the upper cap 112 and the high and low pressure separation plate 115 according to this implementation and the operating effects thereof are the same as those in the previous implementation. For example, the discharge guide 1121 described above may be formed on the axial inner circumferential surface (lower surface) 112*a* of the upper cap 112. Since the discharge guide 1121 is formed in the same manner as in the previous implementations, the description of the discharge guide 1121 will be replaced with the description in the previous implementations. In addition, in some cases, the insulation unit 180, such as the insulation cover 181, the insulation space 182, or the insulation layer 183 may further be disposed on the upper surface of the high and low pressure separation plate 115. Since the insulation unit 180 is configured the same/like as that of the implementation illustrated in FIGS. 18 to 21, a detailed description thereof will be omitted.

As illustrated in FIG. 22, the suction guide 190 according to this implementation may be formed integrally with the non-orbiting scroll 140. This can suppress an increase in the number of assembly processes of the compressor and an increase in manufacturing cost of the compressor due to the suction guide 190.

The suction guide 190 may be formed such that at least a portion thereof is located between the refrigerant suction pipe 117 and the high and low pressure separation plate 115 at the same height as the inlet of the compression chamber V or at a position higher than the inlet of the compression chamber V. Accordingly, suction refrigerant suctioned into the low-pressure part 110*a* can be blocked by the suction guide 190. This can prevent the suction refrigerant from being affected directly or indirectly by or being in contact with the high and low pressure separation plate 115 before being suctioned into the compression chamber.

Specifically, the suction guide 190 may extend radially between the plurality of guide protrusions 144 extending from the non-orbiting side wall portion 143 of the non-orbiting scroll 140, or may be recessed into one of the plurality of guide protrusions 144.

The suction guide 190 includes a suction guide protrusion 191 and a suction guide passage 192. The suction guide protrusion 191 may extend from an outer circumferential surface of the non-orbiting side wall portion 143 toward an inner circumferential surface of the cylindrical shell 111. The suction guide passage 192 may be formed through the inside of the suction guide protrusion 191 such that the low-pressure part 110*a* and the compression chamber V communicate with each other. Accordingly, the suction guide 190 may be formed such that the low-pressure part 110*a* and the compression chamber (precisely, the inlet of the suction pressure chamber) V can communicate with each other.

The suction guide protrusion 191 may include an outer wall surface 191*a*, a side wall surface 191*b*, an upper wall surface 191*c*, a lower wall surface 191*d*, and an inner wall surface 191*e*.

The outer wall surface 191*a* is a surface facing the radial inner circumferential surface of the cylindrical shell 111 or the radial inner circumferential surface of the high and low pressure separating plate 115, and forms an outer circumferential surface of the suction guide passage 192. The outer wall surface 191*a* is formed in a closed shape. Accordingly, refrigerant suctioned through the suction guide passage 192 can be blocked by the outer wall surface 191*a* to be prevented from being in contact with the casing 110 or the high and low pressure separation plate 115, thereby suppressing refrigerant from being overheated from the casing 110 or the high and low pressure separation plate 115.

The outer wall surface 191*a* may also be in contact with the radial inner circumferential surface of the cylindrical shell 111 or the radial inner circumferential surface of the high and low pressure separation plate 115. However, the outer wall surface 191*a* may be spaced apart from the radial inner circumferential surface of the cylindrical shell or the radial inner circumferential surface of the high and low pressure separation plate 115 by a predetermined distance with a spacing 193 interposed therebetween. This can prevent the outer wall surface 191*a* of the suction guide from being heated by transfer heat from the cylindrical shell or the high and low pressure separation plate 115, thereby suppressing an increase in temperature of suction refrigerant.

The side wall surface 191*b* is a surface defining a circumferential side surface of the suction guide passage 192, and may extend radially from each of both sides of the outer surface in the circumferential direction. The side wall surface 191*b* extends to the outer circumferential surface of the non-orbiting side wall portion 143 to block the circumferential side surface of the suction guide passage 192. Accordingly, suction refrigerant can be guided toward the compression chamber without leakage in the circumferential direction.

The upper wall surface 191*c* is a surface facing the axial inner circumferential surface of the high and low pressure separation plate 115, and defines an upper surface of the suction guide passage 192. The upper wall surface 191*c* may be formed in a closed shape by connecting an upper end of the outer wall surface 191*a* and upper ends of both of the side wall surfaces 191*b*. Accordingly, refrigerant suctioned through the suction guide passage 192 can be prevented from being heated by conductive heat or radiant heat transmitted by the high and low pressure separation plate 115.

The lower wall surface 191*d* is a surface defining a lower surface of the suction guide passage 192 and is opened toward the refrigerant suction pipe. Accordingly, the lower wall surface 191*d* defines an inlet of the suction guide passage 192 while defining an open surface.

The inner wall surface 191*e* is a surface defining an inner circumferential surface of the suction guide passage 192, and is open toward the compression chamber (suction pressure chamber). Accordingly, the inner wall surface 191*e* defines an outlet of the suction guide passage 192 while defining an open surface.

When the suction guide is provided between the refrigerant suction pipe and the high and low pressure separation plate 115 as described above, suction refrigerant can be prevented from be heated by heat transferred from the high-pressure part 110*b* to the low-pressure part through the high and low pressure separation plate 115 before being suctioned into the compression chamber V. With the configuration, an increase in specific volume of refrigerant suctioned into the compression chamber can be suppressed, and thus am amount of refrigerant suctioned can increase, thereby improving efficiency of the compressor.

In addition, when the suction guide 190 as in this implementation is provided in the low-pressure part 110*a*, the suction guide 190 can effectively prevent, together with the discharge guide 1121 disposed in the high-pressure part 110*b*, suction refrigerant from being heated. That is, as the discharge guide 1121 is provided in the high-pressure part 110*b*, heat transferred from the high-pressure part 110*b* to the high and low pressure separation plate 115 can be lowered primarily. And, as the suction guide 190 is installed in the low-pressure part 110*a*, heat transferred from the high-pressure part 110*b* to the low-pressure unit 110*a* through the high and low pressure separation plate 115 can be lowered secondarily. This can effectively prevent suction refrigerant of the low-pressure part 110*a* from being heated before being suctioned into the compression chamber V, thereby further increasing compressor efficiency.

Although not illustrated, when the insulation unit 180 is provided in the high and low pressure separating plate 115, heat transferred from the high-pressure part 110*b* to the low-pressure part 110*a* can be further lowered, thereby more effectively preventing suction refrigerant of the low-pressure part 110*a* from being heated. In this way, compressor efficiency can be further improved.

Referring to FIG. 23, the suction guide 190 according to this implementation may be manufactured separately from the non-orbiting scroll 140 and post-assembled to the non-orbiting scroll 140. For example, the suction guide 190 may include a fixing portion 194 to be fastened to the non-orbiting scroll 140 so as to be supported in the axial direction. Accordingly, an insulating material or the like can be freely selected as the material of the suction guide 190, which can facilitate processing of the non-orbiting scroll 140 and further improve an insulation effect.

The basic configuration of the suction guide 190 and its operating effects are similar to those of the implementation of FIG. 19. For example, the suction guide 190 according to this implementation is configured such that the outer wall surface 191*a* facing the radial inner circumferential surface of the cylindrical shell 111 or the radial inner circumferential surface of the high and low pressure separation plate 115, the side wall surfaces 191*b* extending from both sides of the outer wall surface 191*a*, and the upper wall surface 191*c* connecting the outer wall surface 191*a* and the side wall surfaces 191*b* and facing the axial inner circumferential surface of the high and low pressure separation plate 115 are all blocked (closed), and the lower wall surface 191*d* facing the refrigerant suction pipe 117 and the inner wall surface 191*e* facing the compression chamber V are open.

Even in this case, the outer wall surface 191*a* of the suction guide may be in contact with the radial inner circumferential surface of the cylindrical shell 111 or the radial inner circumferential surface of the high and low pressure separation plate 115, or may be spaced apart from the radial inner circumferential surface of the cylindrical shell 111 or the radial inner circumferential surface of the high and low pressure separation plate 115 by the spacing 193.

For example, when the suction guide 190 is formed of an insulating material such as synthetic resin, even if it comes into contact with the radial inner circumferential surface of the cylindrical shell 111 or the radial inner circumferential surface of the high and low pressure separation plate 115, the suction guide 190 can prevent the transfer of heat from the cylindrical shell 111 or the high and low pressure separation plate 115. However, since the suction guide 190 may be deformed or damaged by heat generated when welding the cylindrical shell 111 and the high and low pressure separation plate 115, it can be advantageous in terms of reliability that the suction guide 190 is spaced apart from the radial inner circumferential surface of the cylindrical shell 111 or the radial inner circumferential surface of the high and low pressure separation plate 115.

Hereinafter, a description will be given of another implementation of a refrigerant discharge pipe.

That is, in the previous implementation, the refrigerant discharge pipe is radially connected to the upper cap, but in some cases, the refrigerant discharge pipe may be connected to the upper cap in the axial direction.

Figure 24:
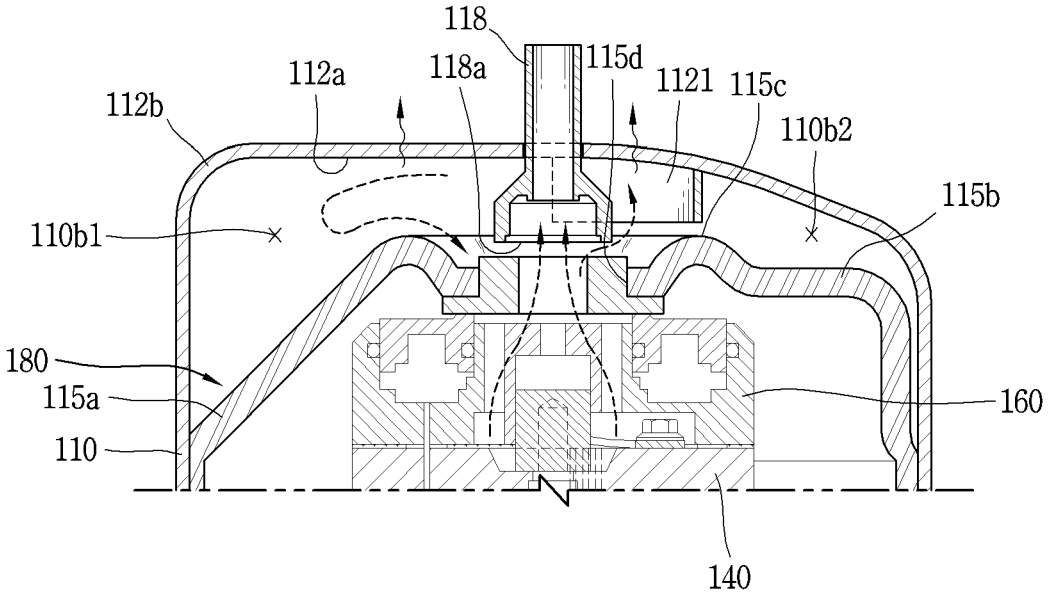
FIG. 24 is a longitudinal sectional view illustrating another implementation of a refrigerant discharge pipe in FIG. 1.

FIG. 24 is a longitudinal sectional view illustrating another implementation of the liquid refrigerant discharge unit in FIG. 1.

Referring to FIG. 24, the basic configurations of the upper cap 112 and the high and low pressure separation plate 115 according to this implementation and the operating effects thereof are similar to those in the previous implementation. Accordingly, the description of the upper cap 112 and the high and low pressure separation plate 115 will be replaced with the description of the previous implementation.

However, as the refrigerant discharge pipe 118 according to this implementation is formed through the upper cap 112 in the axial direction, the discharge guide 1121 may be excluded. In other words, the discharge guide 1121 is a component for allowing discharge refrigerant passing through the through hole 115*d* of the high and low pressure separation plate 115 to rapidly move to the refrigerant discharge pipe 118 when the through hole 115*d* of the high and low pressure separation plate 115 and an end portion of the refrigerant discharge pipe 118 are far apart from each other. However, when the refrigerant discharge pipe 118 passes through a central portion of the upper cap 112 in the axial direction, discharge refrigerant can be directly guided to the refrigerant discharge pipe 118 even if the discharge guide 1121 is not provided. Accordingly, the discharge guide 1121 may be excluded.

However, the discharge guide 1121 may act as a kind of heat dissipation fin that increases a heat transfer area of the upper cap and also guide heat of discharge refrigerant, which is not directly guided to the refrigerant discharge pipe 118, to be quickly dissipated to the upper cap 112. In addition, the discharge guide 1121 can forcibly move discharge refrigerant, which is not directly guided to the refrigerant discharge pipe 118, into a relatively large space (for example, a space opposite the first protrusion of the high and low pressure separation plate), so as to minimize overheating of the high and low pressure separation plate 115 and simultaneously compensate for a lowered pressure pulsation reduction effect in the high-pressure part 110*b*. Accordingly, the discharge guide 1121 described above can be disposed on the axial inner circumferential surface of the upper cap 112. In this case, since the discharge guide 1121 is formed almost similarly to those in the previous implementations, a description thereof will be replaced with a description of the previous implementations.

The refrigerant discharge pipe 118 according to this implementation may be axially connected to the rotating shaft 125 through the axial inner circumferential surface (lower surface) 112*a* of the upper cap 112, and the lower end, namely, the inlet of the refrigerant discharge pipe 118 may at least partially overlap the through hole 115*d* of the high and low pressure separation plate 115 in the axial direction.

For example, the high and low pressure separation plate 115 may include a second protrusion 115*c* protruding toward the axial inner circumferential surface (lower surface) 112*a* of the upper cap 112 around the through hole 115*d*, a first protrusion 115*b* extending radially from the outside of the second protrusion 115*c*, and an inclined surface portion 115*a* formed lower than the first protrusion 115*b* in the circumferential direction of the first protrusion 115*b*.

The refrigerant discharge pipe 118 may be inserted through the upper cap 112 in the axial direction to communicate with the high-pressure part 110*b* such that its inlet is located on the same axis as the through hole 115*d*.

As described above, when the refrigerant discharge pipe 118 is formed on the same axis as the through hole 115*d*, refrigerant discharged from the compression part to the high-pressure part 110*b* can flow directly to the outside of the compressor through the refrigerant discharge pipe 118 located directly above the through hole 115*d* of the high and low pressure separation plate 115. This can prevent high-temperature refrigerant discharged to the high-pressure part 110*b* from coming into contact with the high and low pressure separation plate 115 in advance, thereby preventing the high and low pressure separation plate 115 from being overheated. This may result in reducing heat transferred from the high-pressure part 110*b* to the low-pressure unit

110*a* through the high and low pressure separation plate 115, thereby suppressing an increase in specific volume of suction refrigerant.

Also in this case, the insulation unit 180 may be formed on the high and low pressure separation plate 115 or the suction guide 190 may be formed on the low-pressure part 110*a*. Since the operating effects thereof are the same as those in the previous implementations, a description thereof will be replaced with the description in the previous implementations.

Although not illustrated, the upper cap 112 may alternatively be formed in the shape of dome with a central portion convex. However, in this case, since a volume of a discharge space to attenuate vibration noise generated during discharge, such as pressure pulsation, may be reduced, the central portion of the upper cap 112 may be formed higher than that in the previous implementations.

What is claimed is:

1. A scroll compressor comprising:

a casing;

a refrigerant suction pipe and a refrigerant discharge pipe that are connected to the casing;

a compression part disposed at the casing and configured to receive a rotational force of a motor through a rotating shaft and compress refrigerant in a compression chamber between a non-orbiting scroll and an orbiting scroll; and a high and low pressure separation plate disposed at a side of the compression part in an axial direction and defining (i) a low-pressure part connected to the refrigerant suction pipe and (ii) a high-pressure part connected to the refrigerant discharge pipe, the high and low pressure separation plate defining a through hole through a central portion of the high and low pressure separation plate, the through hole being configured to guide the refrigerant discharged from the compression part toward the high-pressure part, wherein the high-pressure part includes a discharge guide configured to guide the refrigerant discharged from the compression part to the refrigerant discharge pipe, wherein the discharge guide extends from at least one of (i) an inner circumferential surface of the casing that defines the high-pressure part or (ii) a side surface of the high and low pressure separation plate that faces the high-pressure part from an opposite side to the inner circumferential surface of the casing that defines the high-pressure part wherein the high and low pressure separation plate includes:

an inclined surface portion extending between a central portion of the high and low pressure separation plate and a rim of the high and low pressure separation plate and being downwardly inclined towards the low-pressure part from the central portion to the rim; and a first protrusion protruding from a middle of the inclined surface portion in a circumferential direction and extending in a radial direction, and wherein the discharge guide is disposed between the first protrusion and the through hole.

2. The scroll compressor of claim 1, wherein the discharge guide has a first axial end coupled to or extending from the casing, and a second axial end being open and spaced apart from the high and low pressure separation plate.

3. The scroll compressor of claim 2, wherein the discharge guide at least partially surrounds a periphery of the through hole, and wherein a portion of the discharge guide is open toward the refrigerant discharge pipe.

4. The scroll compressor of claim 1, wherein the refrigerant discharge pipe is connected to the casing and positioned to face the inclined surface portion, the refrigerant discharge pipe being at one side of the discharge guide, and the first protrusion being at another side of the discharge guide in an opposing relationship thereto, wherein the discharge guide intersects a first center line passing through an axial center of the rotating shaft and extending in a longitudinal direction of the refrigerant discharge pipe, and wherein the discharge guide is symmetrical with respect to the first center line.

5. The scroll compressor of claim 1, wherein the refrigerant discharge pipe is connected to the casing and positioned to face the inclined surface portion, the refrigerant discharge pipe being at one side of the discharge guide, and the first protrusion being at another side of the discharge guide in an opposing relationship thereto, wherein the first protrusion is formed eccentrically in the circumferential direction with respect to a first center line passing through an axial center of the rotating shaft and extending in a longitudinal direction of the refrigerant discharge pipe, wherein the discharge guide intersects the first center line, and wherein the discharge guide is asymmetrical with respect to the first center line.

6. The scroll compressor of claim 1, wherein the high and low pressure separation plate includes:

an inclined surface portion extending between a central portion of the high and low pressure separation plate and a rim of the high and low pressure separation plate and being downwardly inclined towards the low-pressure part from the central portion to the rim;

a first protrusion protruding from a middle of the inclined surface portion in a circumferential direction toward a radial inner circumferential surface of the casing; and a second protrusion protruding from an upper end of the inclined surface portion toward an axial inner circumferential surface of the casing and surrounding the through hole, wherein the discharge guide overlaps the second protrusion in the axial direction and extends in an arcuate shape along the second protrusion, and wherein the discharge guide has an arcuate length that is longer than or equal to an arcuate length of the first protrusion.

7. The scroll compressor of claim 1, wherein the high and low pressure separation plate includes:

an inclined surface portion extending between a central portion of the high and low pressure separation plate and a rim of the high and low pressure separation plate and being downwardly inclined towards the low-pressure part from the central portion to the rim, a first protrusion protruding from a middle of the inclined surface portion in a circumferential direction toward a radial inner circumferential surface of the casing, and a second protrusion protruding from an upper end of the inclined surface portion toward an axial inner circumferential surface of the casing and surrounding the through hole, and wherein the discharge guide obliquely extends at each of both sides of a first center line, the first center line passing through an axial center of the rotating shaft and extending in a longitudinal direction of the refrigerant discharge pipe, and wherein the discharge guide extends across the second protrusion, a first end of the discharge guide being located more inward than the second protrusion and a second end of the discharge guide being located more outward than the second protrusion.

8. The scroll compressor of claim 1, wherein the discharge guide includes a plurality of discharge guides that are disposed to at least partially surround the through hole, and the plurality of discharge guides are spaced apart from one another in a radial direction outwardly away from the through hole, and wherein a uniform axial gap is defined between each of the plurality of discharge guides and the high and low pressure separation plate.

9. The scroll compressor of claim 1, wherein the discharge guide includes a plurality of discharge guides that include (i) a first discharge guide adjacent the through hole and (ii) a second discharge guide farther apart from the through hole than the first discharge guide, wherein the plurality of discharge guides are disposed to at least partially surround the through hole, and are spaced apart from one another in a radial direction outwardly away from the through hole, and wherein a first axial gap between the first discharge guide and the high and low pressure separation plate is larger than a second axial gap between the second discharge guide and the high and low pressure separation plate.

10. The scroll compressor of claim 1, wherein the discharge guide includes a plurality of discharge guides that include first discharge guides adjacent the through hole and second discharge guides farther apart from the through hole than the first discharge guides, wherein the plurality of discharge guides are disposed to at least partially surround the through hole and are spaced apart from one another in a radial direction outwardly away from the through hole, and wherein a first radial gap between the first discharge guides is larger than a second radial gap between the second discharge guides.

11. The scroll compressor of claim 1, wherein the discharge guide includes a plurality of discharge guides that are disposed to at least partially surround the through hole, and the plurality of discharge guides are spaced apart from one another in a radial direction outwardly away from the through hole, wherein a circumferential passage having both ends open is defined between the plurality of discharge guides, and is in fluid communication with a radial passage passing through the discharge guide in a radial direction, and wherein a discharge guide of the plurality of discharge guides that is located at an outermost side relative to other discharge guides of the plurality of discharge guides and (ii) located farthest away from the rotating shaft is seamlessly formed along a circumferential direction and is configured to transition the radial passage to the circumferential passage.

12. The scroll compressor of claim 1, wherein the discharge guide includes a plurality of discharge guides that are disposed radially, and wherein the discharge guide comprises:

a fixed plate portion coupled to the casing, and a plurality of blocking portions extending from the fixed plate portion toward the high and low pressure separation plate.

13. The scroll compressor of claim 1, wherein the high and low pressure separation plate includes:

an inclined surface portion extending between a central portion of the high and low pressure separation plate and a rim of the high and low pressure separation plate and being downwardly inclined towards the low-pressure part from the central portion to the rim;

a first protrusion protruding from a middle of the inclined surface portion in a circumferential direction toward a radial inner circumferential surface of the casing; and a second protrusion protruding from an upper end of the inclined surface portion toward an axial inner circumferential surface of the casing and surrounding the through hole, wherein the discharge guide extends integrally from the second protrusion toward the high-pressure part and has a curved shape, the curved shape extending away from the first protrusion and wherein a space defined by the curved shape faces toward the refrigerant discharge pipe.

14. The scroll compressor of claim 13, wherein the high and low pressure separation plate includes a discharge guide groove recessed axially from a middle of the second protrusion in the circumferential direction, and wherein the discharge guide groove is defined at a position intersecting a first center line that passes through an axial center of the rotating shaft and extends in a longitudinal direction of the refrigerant discharge pipe.

15. The scroll compressor of claim 1, further comprising an insulation cover disposed at an axial side surface of the high and low pressure separation plate that defines the high-pressure part, and wherein the insulation cover contacts a side surface of the high and low pressure separation plate that defines the high-pressure part, and includes a separation-preventing portion formed uneven between the insulation cover and the high and low pressure separation plate.

16. The scroll compressor of claim 1, further comprising an insulation cover disposed a surface of the high and low pressure separation plate that defines the high-pressure part, wherein the insulation cover is spaced apart from a side surface of the high and low pressure separation plate to thereby define an insulation space between the axial side surface of the high and low pressure separation plate and a side surface of the insulation cover facing the high and low pressure separation plate, and wherein a support protrusion extends from one of the axial side surface of the high and low pressure separation plate and the side surface of the insulation cover.

17. The scroll compressor of claim 1, wherein an insulation layer is coated at an axial side surface of the high and low pressure separation plate.

18. The scroll compressor of claim 1, wherein the high and low pressure separation plate includes an inclined surface portion extending between a central portion of the high and low pressure separation plate and a rim of the high and low pressure separation plate and being downwardly inclined towards the low-pressure part from the central portion to the rim;

a first protrusion protruding from a middle of the inclined surface portion in a circumferential direction toward a radial inner circumferential surface of the casing; and a second protrusion protruding from an upper end of the inclined surface portion toward the high-pressure part and surrounding the through hole, wherein the refrigerant discharge pipe is connected through an inner circumferential surface of the casing, and at least a portion of the refrigerant discharge pipe axially overlaps the through hole of the high and low pressure separation plate, and wherein the refrigerant discharge pipe is coaxial with the through hole.

19. The scroll compressor of claim 1, further comprising a suction guide that is connected to a non-orbiting scroll defining the compression part between the high and low pressure separation plate and the non-orbiting scroll, the suction guide being configured to guide refrigerant suctioned into the low-pressure part to be suctioned into the compression chamber, wherein the suction guide comprises:

a suction guide protrusion extending from an outer circumferential surface of the non-orbiting scroll toward the inner circumferential surface of the casing, and a suction guide passage formed through an inside of the suction guide protrusion, the low-pressure part and the compression chamber being in fluid communication with each other, and wherein the suction guide protrusion has (i) an outer wall surface radially facing the inner circumferential surface of the casing or the inner circumferential surface of the high and low pressure separation plate, (ii) side wall surfaces extending from both sides of the outer wall surface in a circumferential direction, (iii) an upper wall surface connecting the outer wall surface and the side wall surfaces and facing an axial inner surface of the high and low pressure separation plate, and (iv) a lower wall surface facing the refrigerant suction pipe and an inner wall surface facing the compression chamber, wherein the outer wall surface, the side wall surfaces, and the upper wall surface are closed, and wherein the lower wall surface is open.

20. The scroll compressor of claim 19, wherein the outer wall surface of the suction guide protrusion is radially spaced apart from the inner circumferential surface of the casing or the inner circumferential surface of the high and low pressure separation plate.

* * * * *